US007533873B2

(12) United States Patent
Nagasaka et al.

(10) Patent No.: US 7,533,873 B2
(45) Date of Patent: May 19, 2009

(54) CARBONIC WATER PRODUCTION APPARATUS AND CARBONIC WATER PRODUCTION METHOD

(75) Inventors: Yoshinori Nagasaka, Tokyo (JP); Hiroki Sakakibara, Tokyo (JP); Yuichi Morioka, Tokyo (JP); Katsuya Sanai, Tokyo (JP); Michio Kanno, Tokyo (JP); Satoshi Takeda, Tokyo (JP)

(73) Assignees: Mitsubishi Rayon Engineering Co., Ltd., Tokyo (JP); Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 11/808,529

(22) Filed: Jun. 11, 2007

(65) Prior Publication Data

US 2008/0001311 A1 Jan. 3, 2008

Related U.S. Application Data

(62) Division of application No. 11/001,333, filed on Dec. 1, 2004, now Pat. No. 7,246,793, which is a division of application No. 10/258,031, filed as application No. PCT/JP01/03309 on Apr. 18, 2001, now Pat. No. 6,905,111.

(30) Foreign Application Priority Data

| | | |
|---|---|---|
| Apr. 18, 2000 | (JP) | 2000-116501 |
| Apr. 18, 2000 | (JP) | 2000-116502 |
| Apr. 18, 2000 | (JP) | 2000-116503 |
| Aug. 10, 2000 | (JP) | 2000-242601 |
| Aug. 21, 2000 | (JP) | 2000-249738 |
| Aug. 30, 2000 | (JP) | 2000-260701 |

(51) Int. Cl.
*B01F 3/04* (2006.01)

(52) U.S. Cl. ..... 261/38; 261/104; 261/DIG. 7

(58) Field of Classification Search ..... 261/36.1, 261/37, 38, 53, 62, 64.3, 72.1, 74, 77, 94, 261/95, 96, 100, 101, 102, 104, 121.1, 122.1, 261/DIG. 7

See application file for complete search history.

(56) References Cited

U.S. PATENT DOCUMENTS 3,643,688 A 2/1972 Harmut (Continued)

FOREIGN PATENT DOCUMENTS

EP 0 968699 A 1/2000

(Continued)

*Primary Examiner*—Scott Bushey
(74) *Attorney, Agent, or Firm*—Fitch, Even, Tabin & Flannery

(57) ABSTRACT

A carbonic water production apparatus equipped with a carbonic acid gas dissolving apparatus and a circulation pump, wherein water in a bath is circulated by the circulation pump, and carbonic acid gas is fed into the carbonic acid gas dissolving apparatus to dissolve the carbonic acid gas in the water, and wherein the circulation pump is a positive-displacement metering pump having a self-priming ability; a carbonic water production method using this apparatus; a carbonic water production method including an early step for producing a carbonic water and a concentration maintaining step for the carbonic water; a carbonic water production apparatus equipped with a device for controlling the feeding pressure of carbonic water gas so as to give an intended concentration of carbonic acid gas; a carbonic water production apparatus which automatically discharges out a drain; and a carbonic water production apparatus combined with a portable foot bath.

6 Claims, 10 Drawing Sheets

U.S. PATENT DOCUMENTS

| | | | | |
|---|---|---|---|---|
| 3,977,606 | A | | 8/1976 | Wyss et al. |
| 4,562,013 | A | * | 12/1985 | Jeans ..... 261/50.3 |
| 4,629,591 | A | | 12/1986 | Forsyth et al. |
| 5,505,841 | A | | 4/1996 | Pirbazari et al. |
| 5,565,149 | A | | 10/1996 | Page et al. |
| 5,842,600 | A | | 12/1998 | Singleterry et al. |
| 5,855,296 | A | * | 1/1999 | McCann et al. ..... 222/61 |
| 6,164,632 | A | | 12/2000 | Uchida et al. |
| 6,905,111 | B2 | | 6/2005 | Nagasaka et al. |
| 2004/0238975 | A1 | | 12/2004 | Sakakibara et al. |

FOREIGN PATENT DOCUMENTS

| | | | |
|---|---|---|---|
| FR | 595 751 | A | 10/1925 |
| GB | 2246523 | A | 2/1992 |
| JP | 49-23280 | | 6/1974 |
| JP | 61-164630 | | 7/1986 |
| JP | 02-279158 | | 11/1990 |
| JP | 05-115521 | | 5/1993 |
| JP | 06-198152 | | 7/1994 |
| JP | 06-198152 | A | 7/1994 |
| JP | 07-096156 | | 4/1995 |
| JP | 08-215270 | | 8/1996 |
| JP | 08-215270 | A | 8/1996 |
| JP | 08-215271 | | 8/1996 |
| WO | WO 95/06010 | A | 3/1995 |
| WO | WO 98/34579 | | 8/1998 |

* cited by examiner

CARBONIC WATER PRODUCTION APPARATUS AND CARBONIC WATER PRODUCTION METHOD

CROSS-REFERENCED APPLICATIONS

This application is a divisional of U.S. application Ser. No. 11/001,333 filed Dec. 1, 2004, now U.S. Pat. No. 7,246,793, which is a divisional application of U.S. application Ser. No. 10/258,031, filed Oct. 18, 2002, now U.S. Pat. No. 6,905,111, the complete disclosures of which are incorporated herein by reference, which was the National Phase of PCT International Application PCT/JP01/03309, filed Apr. 18, 2001, which designated the U.S. and that International Application was not published under PCT Article 21(2) in English.

TECHNICAL FIELD

The present invention relates to an apparatus and a method for producing carbonic water which is useful, for example, in hydrotherapy for the purpose of improving physiological functions.

BACKGROUND ART

Carbonic water is assumed to be effective for treatment of regressive diseases and peripheral circulatory disorders. For example, there is a method in which a carbonic acid gas is fed in the form of bubbles into a bath (bubbling method), as a method of artificially producing carbonic water. However, the dissolving ratio is low, and the dissolution time is long in this method. Further, another method is a chemical method in which a carbonate salt is reacted with an acid (chemical method). However, it is necessary to add chemical materials at a large amount, and it is impossible to keep a clearness in this method. Additionally, there is a method in which hot water and carbonic acid gas are sealed in a tank for a period while it is pressurized (pressure method). However, the size of the apparatus increases impractically in this method.

Currently, commercially marketed apparatuses of producing carbonic water are usually used for producing carbonic water having a low concentration of carbonic acid gas which is about 100 to 140 mg/L. The apparatuses have no means of controlling the concentration of carbonic acid gas.

On the other hand, Japanese Patent Application Laid-Open (JP-A) No. 2-279158 discloses a method in which a carbonic acid gas is fed through a hollow fiber semi-permeable membrane and absorbed by hot water. Further, JP-A No. 8-215270 discloses a method in which a pH sensor is put in a bath, and the feeding rate of carbonic acid gas into a carbonic acid gas dissolving apparatus for maintaining the concentration of carbonic acid gas of water in the bath at a constant level is controlled. Furthermore, International Publication No. 98/34579 pamphlet discloses a method in which concentration data for carbonic acid gas from carbonic water produced is calculated from the pH value of carbonic water and the alkalinity of raw water. The feeding rate of carbonic acid gas is controlled so that the concentration of carbonic acid gas in carbonic water can reach an intended value. These are methods in which carbonic water is produced by passing once raw water through the carbonic acid gas dissolving apparatus equipped with a hollow membrane. The apparatus is called a one-pass type apparatus.

In the one-pass type apparatus, it is necessary to increase the membrane area of the hollow fiber membrane or increase the pressure of carbonic acid gas in order to produce carbonic water having a high concentration which is excellent in physiological effects (e.g., blood flow increase). However, if the membrane area is increased, the size of the apparatus has to increase, and it causes the cost to increase.

If the pressure of gas is increased, the dissolving ratio becomes low. Furthermore, in the one-pass type apparatus, it is indispensable to have a pipe and a hose connecting between the apparatus and hot water such as tap water. As a result, the setting is necessary when moving the apparatus for use at other places.

On the other hand, carbonic water having a high concentration can be produced efficiently and at low cost by a so-called circulation type apparatus wherein hot water in a bath is circulated by a circulation pump through a carbonic acid gas dissolving apparatus. Additionally, the setting of the circulation type apparatus is very simple because it needs no additional connections as is required in the one path type apparatus, and because it is completed by filling a bath with hot water and putting a carbonic water circulation hose from the apparatus into the bath. Examples of such circulation type carbonic water apparatuses include those disclosed by JP-A Nos. 8-215270 and 8-215271.

Under a condition in which carbonic water having a desired concentration of carbonic acid gas is filled in a bath, the carbonic acid gas in the carbonic water is evaporated, which results in gradually decreasing the concentration of carbonic acid gas. This tendency depends on the size of the bath. Particularly, when a large bath for a large number of people is filled with carbonic water, the amount of evaporation is high, and the concentration of carbonic acid gas quickly decreases. In such a large bath, the hot water is often circulated through a filtration apparatus for cleaning the hot water even when the bath is in use. However, large amounts of the carbonic acid gas evaporate at the filtration apparatus when the carbonic water is filled in such circulation type bath in which the water is circulated through the filtration apparatus.

The method in which the feeding amount of carbonic acid gas is controlled based on the pH value makes a relatively large calculating error in the concentration of carbonic acid gas in the resulting carbonic water. Therefore, it is necessary to add an automatically correcting function to the pH sensor for suppressing the calculating error thereof within ±0.05. This requires complicated control, increases the size of the apparatus, and increases the cost. Additionally, the alkalinity of raw water (e.g., tap water) should be measured to control precisely the concentration of carbonic acid gas.

Examples of carbonic acid gas production apparatuses include so-called one-pass type apparatuses as disclosed in JP-A No. 2-279158 and International Publication No. 98/34579 pamphlet in which carbonic water is produced by passing once raw water through in a carbonic acid gas dissolving apparatus equipped with a hollow fiber membrane, and so-called circulation type apparatuses as disclosed in JP-A Nos. 8-215270 and 8-215271 in which hot water from a bath is circulated through a carbonic acid gas dissolving apparatus by a circulation pump. In any type apparatus, water, as drain, is collected at outside parts of the hollow fiber membrane. This water permeates through the membrane from the hollow part of hollow fiber membrane, or it is generated by condensation of vapor that permeates through the membrane from the hollow part. When this (drain) water comes in contact with the surface of membrane, the surface becomes clogged, and the gas permeation cannot be effectively performed. In conventional apparatuses, an operator appropriately opens a drain valve to discharge the (drain) water collected at the outside parts of the hollow fiber membrane.

It is conventionally known that a foot bath of carbonic water may improve the physiological functions of the foot. In a conventional foot bath, it is necessary that the foot bath is filled with carbonic water that was previously produced, or carbonic water that was produced from hot water filled in the bath by using another apparatus. These operations are complicated. Although a portable type foot bath has an advantage in that the foot bath treatment can be simply conducted in any location, the advantage is restricted by the operations available for producing the carbonic water.

DISCLOSURE OF INVENTION

A first object of the present invention is to realize a more practical circulation type carbonic water production apparatus and to provide an apparatus and a method that can produce carbonic water having a desired concentration of carbonic acid gas (particularly, a high concentration such that physiological effects are obtained) and through a simple operation at low cost.

A second object of the present invention is to provide a method of producing carbonic water which can solve the problem of evaporation of the carbonic acid gas, and can produce and maintain a certain concentration of carbonic acid gas for a long period through a simple operation at low cost.

A third object of the present invention is to provide an apparatus and a method that can produce carbonic water always having a certain concentration of carbonic acid gas (particularly, a high concentration such that physiological effects are obtained) through a simple operation at low cost, and irrespective of the flow rate of raw water.

A fourth object of the present invention is to realize a more practical carbonic water production apparatus, and to provide an apparatus and a method that can produce carbonic water through a simple operation.

A fifth object of the present invention is to provide a carbonic water production apparatus that can be used by a simple operation while retaining the advantages of a portable foot bath.

The first aspect of the invention relates to a carbonic water production apparatus which is equipped with a carbonic acid gas dissolving apparatus and a circulation pump wherein water in a water tank is circulated through the carbonic acid gas dissolving apparatus by the circulation pump, and carbonic acid gas is fed into the carbonic acid gas dissolving apparatus to dissolve the carbonic acid gas in the water, and which is characterized by a circulation pump that is a positive-displacement metering pump with a self-priming ability; and a carbonic water production method which comprises circulating water in a water tank through a carbonic acid gas dissolving apparatus by a circulation pump, and feeding carbonic acid gas into the carbonic acid gas dissolving apparatus to dissolve the carbonic acid gas in the water, wherein a positive-displacement metering pump having a self-priming ability is used as the circulation pump.

Regarding conventional circulation type carbonic water apparatuses, JP-A No. 8-215270 discloses no investigation about which kind of circulation pump is suitable for production of carbonic water. JP-A No. 8-215270 discloses an underwater pump used as the circulation pump. However, bubbling of the circulated carbonic water is caused significantly by swirling pumps such as the underwater pump when the carbonic water has a high concentration. The bubbling may reduce the pump discharge amount and pump head. In the worst case, blades of the pump are often idle so that it becomes impossible to circulate the carbonic water.

On the other hand, according to the first aspect of the present invention, carbonic water can be successfully circulated even if the carbonic water has a high concentration because a positive-displacement metering pump having a self-priming ability is used. This means that a water tank can be filled with carbonic water having a high concentration.

The second aspect of the present invention relates to a carbonic water production method which comprises circulating water in a water tank through a carbonic acid gas dissolving apparatus by a circulation pump, and feeding carbonic acid gas into the carbonic acid gas dissolving apparatus to dissolve the carbonic acid gas in the water, and which is characterized as comprising an initial step of applying a necessary pressure of the carbonic acid gas in order to produce a carbonic water having a desired concentration of carbonic acid gas in the initial circulation of the water for producing the carbonic water, and a concentration maintaining step of applying a necessary pressure of the carbonic acid gas and circulating the carbonic water in order to maintain the desired concentration of carbonic acid gas of the carbonic water produced at this initial step.

The second aspect of the present invention is a method in which carbonic water having a high concentration is efficiently produced in an initial step, and furthermore, the concentration of carbonic acid gas is maintained by also applying the carbonic acid gas process to water which is circulated for cleaning in use, particularly while a large bath for a large number of people is in use. This method can produce and maintain a certain concentration of carbonic acid gas for a long period through a simple operation at low cost.

The third aspect of the present invention relates to a carbonic water production apparatus which feeds carbonic acid gas into a carbonic acid gas dissolving apparatus thereof while feeding raw water therein to dissolve the carbonic acid gas in the raw water, and which is characterized by previously recorded correlation data of the flow rate of raw water with the feed pressure of carbonic acid gas and the concentration of carbonic acid gas which results in the carbonic water, and is equipped with a means for detecting the flow rate of raw water and controlling the feed pressure of carbonic acid gas according to the correlation data so that the resulting carbonic water has the intended concentration of carbonic acid gas at the time of producing the carbonic water; and a carbonic water production method which comprises feeding carbonic acid gas into a carbonic acid gas dissolving apparatus while feeding raw water for the carbonic acid gas to dissolve, and which is characterized by comprising a step of previously recording correlation data of the flow rate of raw water with the feed pressure of carbonic acid gas and the concentration of carbonic acid gas in the resulting carbonic water, and a step of detecting the flow rate of raw water and controlling the feed pressure of carbonic acid gas according to the correlation data so that the resulting carbonic water has the intended concentration of carbonic acid gas at the time of producing the carbonic water.

According to the third aspect of the present invention, the carbonic water always having a certain high concentration can be produced by a simple operation at low cost without depending on controlling the flow rate of raw water, as compared with a conventional method in which the feed amount of carbonic acid gas is controlled based on the measured value of the pH.

The fourth aspect of the present invention relates to a carbonic water production apparatus which is equipped with a membrane type carbonic acid gas dissolving apparatus and which is characterized by being equipped with an automatic water extraction means for automatically discharging the excess water accumulated in the membrane type carbonic acid gas dissolving apparatus; and a carbonic water production method which applies a membrane type carbonic acid gas dissolving apparatus, and which is characterized by comprising a step of automatically discharging the excess accumulated in the membrane type carbonic acid gas dissolving apparatus.

According to the fourth aspect of the present invention, an effective membrane area can always be ensured and a high concentration of carbonic acid gas in carbonic water can be successfully produced by the simple operation described without manual water extraction by hand operation.

The fifth aspect of the present invention relates to a carbonic water production apparatus which is characterized by being combined with a portable foot bath.

In the fifth aspect of the present invention, the term "portable" means that the foot bath is not fixed at a certain place, and if necessary, can be carried and moved. The carrying method is not particularly restricted. According to the fifth present invention, a bath can be provided, which can be used by a simple operation, while retaining the advantages of portable foot baths.

BEST MODE FOR CARRYING OUT THE INVENTION

EMBODIMENTS OF THE FIRST ASPECT OF THE PRESENT INVENTION

Figure 1:
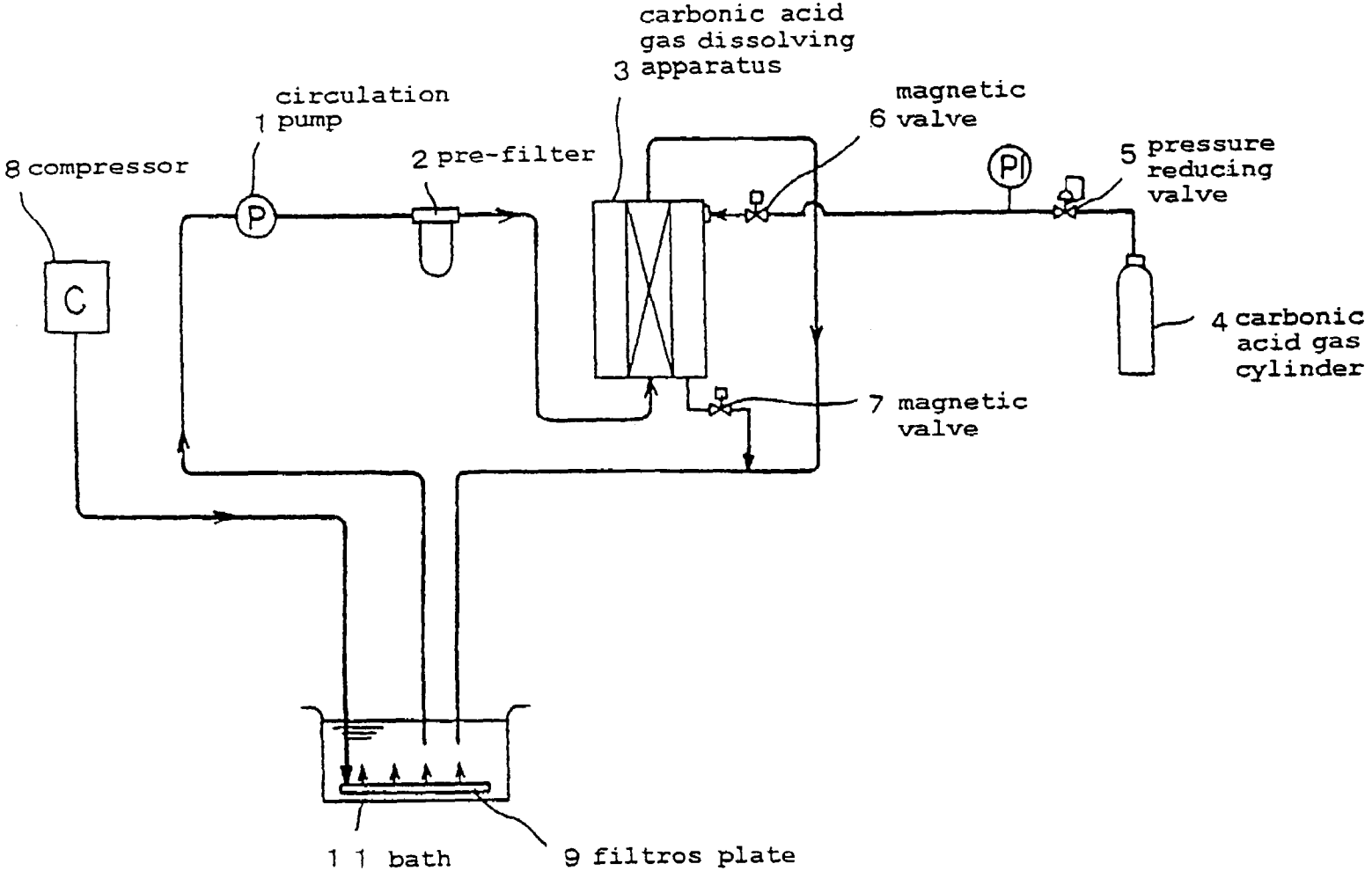
FIG. 1 is a flow sheet showing one example of using a circulation type carbonic water production apparatus according to the first present invention.

FIG. 1 is a flow sheet showing one example of using a circulation type carbonic water production apparatus according to the first present invention. In this example, hot water in the bath (water tank) 11 is circulated. The temperature of water in the bath 11 is not particularly restricted. Here, temperatures around body temperature or lower are preferable in order to manifest the physiological effects of carbonic water and not to apply surplus load on body and diseased part. Specifically, temperatures of from 32° to 42?C are preferable.

In this example, water in the bath 11 is circulated. Applying an apparatus of the present invention to a bath is a very useful example. However, the first aspect of the present invention is not limited to this. The first aspect can be applied to a water tank (except a bath), which should be filled with a carbonic water having a desired concentration, such as a water storage tank and a feed water tank.

Water to be circulated is not particularly restricted. As water containing no carbonic acid gas at all before circulation is circulated, carbonic water will be produced having a gradually increasing concentration of carbonic acid gas. Furthermore, higher concentrations of carbonic acid gas can be also recovered by circulating carbonic water having a lower concentration of carbonic acid gas.

In the example shown in FIG. 1, hot water in the bath 11 is sucked up by a circulation pump 1, and introduced into the carbonic acid gas dissolving apparatus 3 via the pre-filter 2 for trapping trash (debris) from the hot water, and returns again to the bath 11. The carbonic acid gas is fed from the carbonic acid gas cylinder 4, via the pressure-reducing valve 5 and the magnetic valve 6 which is a cut-off valve for the carbonic acid gas, into the carbonic acid gas dissolving apparatus 3.

The carbonic acid gas dissolving apparatus 3 is a membrane type carbonic acid gas dissolving apparatus constituted of a membrane module having a hollow fiber membrane installed. In this example, carbonic acid gas fed into the carbonic acid gas dissolving apparatus 3 is introduced onto the outer surface of the hollow fiber membrane. Hot water fed in the carbonic acid gas dissolving apparatus 5 flows in a hollow part of the hollow fiber membrane. Subsequently, carbonic acid gas on the outer surface of the hollow fiber membrane comes into contact with hot water flowing in a hollow part of the hollow fiber membrane via a membrane surface, carbonic acid gas is dissolved in hot water to produce carbonic water, and this carbonic water is fed into the bath 11. By thus circulating hot water in the bath 11 by the circulation pump 1 for an optional time, carbonic water having a high concentration of carbonic acid gas will be filled in the bath 11. When contact and dissolution of carbonic acid gas are conducted via a membrane surface of a membrane module as in this example, gas-liquid contact area can be increased, and carbonic acid gas can be dissolved with high efficiency. A membrane module, for example, may include a hollow fiber membrane module and a plate membrane module. A spiral type module can be used. In particular, a hollow fiber membrane module can dissolve carbonic acid gas with high efficiency.

Hot water in the bath 11 increases in concentration of carbonic acid gas over the elapsed circulation time. When con-elation data between the circulation time and the concentration of carbonic acid gas are previously measured, the necessary circulation time can be determined from the correlation data if the intended concentration of carbonic acid gas and feed pressure of carbonic acid gas are known or can be determined. However, the correlation data cannot be utilized if tile amount of water circulated is not always constant. Therefore, it is necessary to use a metering pump as the circulation pump 1. However, according to knowledge of the present inventors, even in the case of metering pumps, a volute pump and the like, correlation data cannot be utilized since the pump flow rate can vary with a change in head, which may occur with clogging of a pre-filter. Additionally, when carbonic water reaches a high concentration, the pump may be stopped because of bubbles.

Therefore, according to the first aspect of the present invention, stable circulation and a constant amount of water circulated are realized by using a positive-displacement metering pump having a self-priming ability as the circulation pump 1. This positive-displacement metering pump has a self-priming ability, which can be activated in the initial operation without priming. Additionally, though carbonic water tends to generate bubbles when its concentration increases, this positive-displacement metering pump can convey water stably (constantly) even under bubble-rich conditions.

This positive-displacement metering pump is very effective particularly when correlation data are obtained (such as previously recorded) for the circulation flow rate of the positive-displacement metering pump, the gas feeding pressure at water amount in water tank, the concentration of carbonic acid gas in carbonic water in the water tank, and the circulation time. Therefore, in producing carbonic water, the circulation time can be controlled based on the above-mentioned correlation data to obtain the carbonic water in the tank having a concentration of carbonic acid gas in the range from 600 mg/L to 1400 mg/L.

Positive-displacement metering pumps having a self-priming ability may consist of, for example, a diaphragm pump, a screw pump, a tube pump, and a piston pump. Among recent commercially available products, a diaphragm pump is optimal from the standpoints of price, ability, size and the like. Examples of diaphragm pumps that can be used are a 3-head diaphragm pump manufactured by SHURflo (US), a 5-head diaphragm pump manufactured by Aquatec Water System (US), a 4-head diaphragm pump manufactured by FLOJET (US), and the like. These commercially available products are usually marketed as booster pumps in a beverage filtration apparatus. Namely, these commercially available products have no relation with a carbonic water production apparatus.

The pressure of carbonic acid gas fed to the carbonic acid gas dissolving apparatus 3 is set by the pressure-reducing valve 5. When this pressure is lower, generation of non-dissolved gas at the carbonic acid gas dissolving apparatus 3 is suppressed, and the dissolution efficiency is higher. The amount of carbonic gas permeating through a hollow fiber membrane in the carbonic acid gas dissolving apparatus 3 is proportional to the feed pressure of the carbonic acid gas, and when the pressure is higher, the permeation amount is higher. Using this information and taking into consideration that when the carbonic acid gas pressure is lower, the production time is longer, and the pressure is appropriately from about 0.01 to 0.3 MPa. The amount of carbonic acid gas absorbed in the circulating hot water depends also on the concentration of carbonic acid gas and the amount of hot water being circulated. When carbonic acid gas over the absorption amount is fed, a non-dissolved gas is formed.

Figure 2:
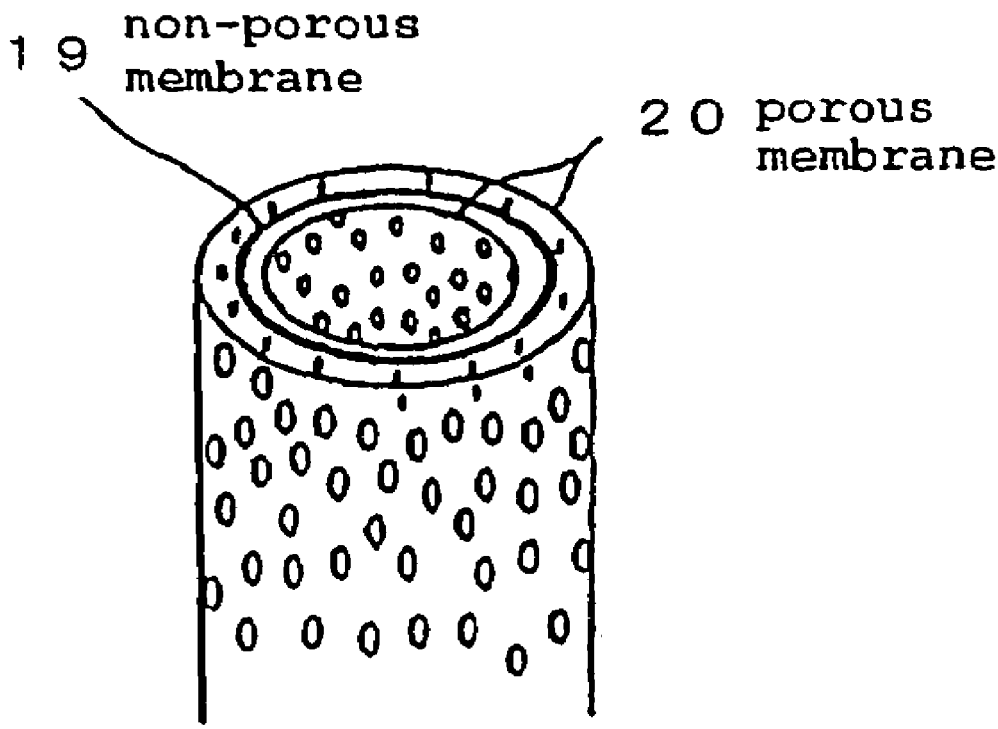
FIG. 2 is a schematic view showing one example of a three-layer complex hollow fiber membrane.

Any material can be used in the carbonic acid gas dissolving apparatus 5 as the hollow fiber membrane, providing it has excellent gas permeability, such as a porous membrane or non-porous gas permeability membrane (hereinafter, abbreviated as "non-porous membrane"). Of the porous hollow fiber membranes, those having an opening pore diameter on their surface of 0.01 to 10 μm are preferable. A hollow fiber membrane containing a non-porous membrane can also be suitably used. The most preferable hollow fiber membrane is a complex hollow fiber membrane having a three-layer structure that comprises a non-porous layer in the form of a thin membrane sandwiched between porous layers. An example is a three layer complex hollow fiber membrane that is commercially available from Mitsubishi Rayon Co. Ltd. (MHF brand membrane, mfr: MRC). FIG. 2 is a schematic view showing one example of such a complex hollow fiber membrane. In the example shown in FIG. 2, a non-porous layer 19 is formed as a very thin membrane excellent in gas permeability, and porous layers 20 are formed on its both surfaces, to protect the non-porous layer 19 so that it is not damaged.

Here, the non-porous layer (membrane) is a membrane through which a gas permeates by a mechanism of dissolution and diffusion into a membrane substrate, and any membrane can be used provided it contains substantially no pore through which a gas can permeate like, for example, a Knudsen flow of molecules. When this non-porous membrane is used, a gas can be supplied and dissolved without discharging carbonic acid gas in the form of bubbles into hot water. Therefore, efficient dissolution is possible. Additionally, the gas can be dissolved simply under excellent control at any concentration. Furthermore, there is no counterflow which can occur in the case of a porous membrane; namely, hot water does not counter-flow to the gas feeding side through fine pores.

The thickness of a hollow fiber membrane is preferably 10 to 150 μm. When the membrane thickness is 10 μm or more, sufficient membrane strength tends to be shown. When the thickness is 150 μm or less, sufficient carbonic acid gas permeation speed and dissolving efficiency are liable to be shown. In the case of a three-layer complex hollow fiber membrane, the thickness of a non-porous membrane is preferably 0.3 to 2 μm. When the membrane thickness is 0.3 μm or more, the membrane does not easily deteriorate, and therefore leakage due to membrane deterioration does not readily occur. When the thickness is 2 μm or less, sufficient carbonic acid gas permeation speed and dissolving efficiency are liable to be shown.

When the volume of water passed per hollow fiber membrane module is 0.2 to 30 L/min and the gas pressure is 0.01 MPa to 0.3 MPa, it is preferable that the membrane area is about 0.1 $m^2$ to 15 $m^2$.

Examples of the membrane materials for a hollow fiber membrane include silicone-based, polyolefin-based, polyester-based, polyamide-based, polysulfone-based, cellulose-based and polyurethane-based materials and the like, which are preferable. As the material of a non-porous membrane of a three-layer complex hollow fiber membrane, polyurethane, polyethylene, polypropylene, poly-4-methylpentene-1, polydimethylsiloxane, polyethylcellulose and polyphenylene oxide are preferable. Among them, polyurethane manifests excellent membrane forming property and provides little eluted substance, and therefore, it is particularly preferable.

The internal diameter of a hollow fiber membrane is preferably 50 to 1000 μm. When the internal diameter is 50 μm or more, the flow route resistance of fluid flowing in a hollow fiber membrane decreases appropriately, and feeding of fluid becomes easy. When 1000 μm or less, the size of a dissolving apparatus can be decreased, providing an advantage in compactness of the apparatus.

When a hollow fiber membrane is used in a carbonic acid gas dissolving apparatus, there are a method in which carbonic acid gas is fed to the hollow side of a hollow fiber membrane, and hot water is fed to the outer surface side to dissolve the carbonic acid gas, and a method in which carbonic acid gas is fed to the outer surface side of a hollow fiber membrane and hot water is fed to the hollow side to dissolve the carbonic acid gas. Among them, the latter method is particularly preferable since carbonic acid gas can be dissolved at a high concentration in hot water irrespective of the form of a membrane module.

Besides the carbonic acid gas dissolving apparatus used in the present invention, there can also be used an apparatus having a gas diffusion means in which a gas diffusing part composed of a porous body is set at the bottom in a carbonic acid gas dissolving apparatus. The material and form of a porous body can be optionally selected, and preferably is one having a void ratio of 5 to 70 vol %. A volume ratio of voids present in the porous body itself is based on the whole porous body. For further enhancing the dissolving efficiency of a carbonic acid gas, a lower void ratio is suitable, particularly a void ratio of 5 to 40 vol % is more preferable. When the void ratio is 70 vol % or less, flow control of carbonic acid gas becomes easier, the gas flow rate can be suitably decreased, bubbles of the carbonic acid gas being diffused from a gas diffusing body do not become large, and the dissolution efficiency is not easily lowered. When the void ratio is 5 vol % or more, sufficient feeding amount of carbonic acid gas can be maintained, and dissolution of the carbonic acid gas tends to be performed in a relatively short time.

The opening pore diameter on the surface of a porous body is preferably 0.01 to 10 μm, for control of the flow rate of carbonic acid gas diffused, and for formation of fine bubbles. When the pore diameter is 10 μm or less, the size of the bubbles rising in water becomes moderately small, and the dissolution efficiency of the carbonic acid gas increases. When the pure diameter is 0.01 μm or more, the amount of gas diffusion into the water increases moderately, and even in the case of obtaining carbonic water of high concentration, the procedure is completed in a relatively short time.

When a porous body placed in a gas diffusion pail of a gas diffusing means has large surface area, bubbles can be generated in larger numbers, contact between carbonic acid gas and raw water progresses efficiently, and dissolution before formation of bubbles also occurs, leading to enhanced dissolution efficiency. Therefore, though the form of a porous body is not limited, a porous body having a larger surface area is preferable. As the means of increasing the surface area, various methods are envisaged such as formation of a porous body in the form of a cylinder, formation of a porous body in the form of a flat plate and providing irregularity on its surface, and the like. However, it is preferable to use a porous hollow fiber membrane. Utilization of many porous hollow fiber membranes bundled is particularly effective.

The material making up a porous body is not particularly restricted, though various materials such as metals, ceramics, and plastics are exemplified. However, hydrophilic materials are not preferable since hot water invades the gas diffusing means through the pores on its surface and stops the feed of carbonic acid gas.

In the case of feeding carbonic acid gas to the outer surface side of a hollow fiber membrane and feeding hot water to the hollow side to dissolve the carbonic acid gas, piping for counterflow washing may be provided. When scale accumulates at a potting opening end, which is a feeding port to the hollow part of a hollow fiber membrane, this scale can be removed relatively simply by counterflow washing.

Regarding carbonic water produced, its concentration of carbonic acid gas is not particularly restricted. In the above-described example, if the value of a desired concentration of carbonic acid gas is input in the apparatus, and hot water in the bath 11 is circulated by the circulation pump 1, then, the apparatus controls the circulation time automatically depending on the desired concentration of carbonic acid gas. As a consequence, carbonic water having desired concentration of carbonic acid gas is filled in the bath 11.

However, in general, to obtain medical physiological effects, the concentration of the carbonic acid gas in the carbonic water is required to be 600 mg/L or more. From this standpoint, the concentration of carbonic acid gas in the carbonic water produced in the present invention is also preferably 600 mg/L or more. On the other hand, when the concentration of carbonic acid gas is higher, the dissolution efficiency of the carbonic acid gas lowers, and additionally, at a certain concentration and above, physiological effects do not increase or decrease. From this standpoint, the upper limit of the concentration of carbonic acid gas is adequately about 1400 mg/L.

In the carbonic water production apparatus, a bubble generation apparatus or an injection apparatus can be further provided. The bubble generation apparatus generates bubbles in the bath water, and the injection apparatus generates water flow (current) in the bath water, to impart physical stimulation to a diseased part of the body and, owing to its massage effect, to promote blood circulation and to attenuate low back pain, shoulder leaning, muscular fatigue and the like. Such an apparatus is marketed currently by companies, and used widely in hospitals, senile health facilities, and homes.

On the other hand, carbonic water produced in the present invention performs an action in which the carbonic acid gas in water is absorbed percutaneously to dilate blood vessels and promote blood circulation. Namely, if an action by bubbles and injection is called a dynamic action, an action by carbonic water can be called a static action. Treatment by carbonic water has the advantage that no stiff load is applied on the body or a diseased part, and little side effect is exerted since it causes no physical stimulation as compared with the bubble generation apparatus and injection apparatus.

In the example shown in FIG. 1, a bubble generating apparatus is further provided with a carbonic water production apparatus according to the first aspect of the present invention to form one united package which is a multi-functional apparatus capable of carrying out both functions in one apparatus. The bubble generation apparatus comprises, at least, a gas diffusion plate 9 placed at a lower part in a bath in use, a compressor 8 for feeding air to this gas diffusion plate 9, and piping connecting both of them. By activating the compressor 8, bubbles develop from the gas diffusion plate 9, and physical stimulation is imparted to a diseased part of a person who is taking a bath.

However, in such a multi-functional apparatus, when a bath is filled with carbonic water, it is recommended that bubbles are not generated. The reason for this is that since the content of a bath is stirred by bubbles, a carbonic acid gas dissolved in carbonic water easily evaporates into air, and the concentration of carbonic water tends to decrease sharply and quickly. Therefore, it is preferable that a carbonic water production function and a bubble generation function not be used simultaneously and that a change switch be provided so that these functions are carried out separately.

Figure 3:
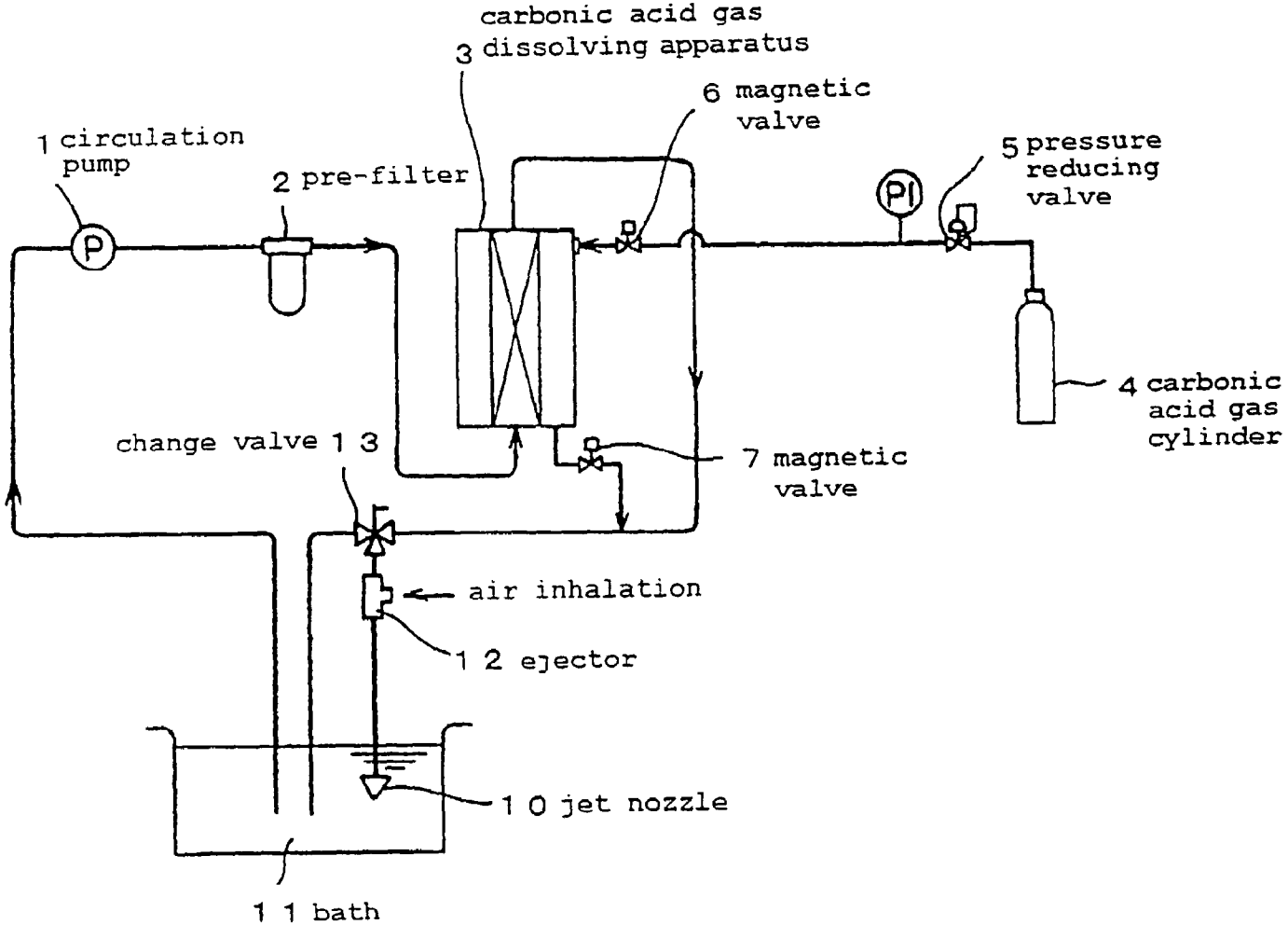
FIG. 3 is a flow sheet showing one example of using a circulation type carbonic water production apparatus according to the first present invention.

FIG. 3 shows one example of another multi-functional apparatus in a carbonic water production apparatus according to the first present invention. This injection apparatus is composed of, at least, a jet nozzle 10 placed in a bath 11 in use, an ejector 12 absorbing air fed to the jet nozzle 10, and piping connecting them. Water flow, bubbles, or the like develop from this jet nozzle 10 and impart a physical stimulation to a diseased part of a person taking a bath. This water flow or bubble generation function is not used together with production of carbonic water, and they are carried out separately by switching using a switch valve 13.

In the apparatus shown in FIG. 1, an automatic water extraction means is further provided. This automatic water extraction means is composed, specifically, of piping for extracting drain from the hollow fiber membrane in the carbonic acid gas dissolving apparatus 3 and a magnetic valve (open valve) 7 placed along the way of the piping. In the carbonic acid gas dissolving apparatus 3, water vapor evaporated from the hollow part of a hollow fiber membrane is condensed on the outside part of a hollow fiber membrane to collect drain, and this drain clogs the membrane surface and effective gas permeation cannot be effected in some cases. The automatic water extracting means opens the magnetic valve (open valve) 7 automatically and periodically, and discharges drain collected in the carbonic acid gas dissolving apparatus 3 out of the apparatus.

In the example shown in FIG. 1, for example, in the carbonic acid gas dissolving apparatus 3 (hollow fiber membrane area: 0.6 $m^2$), the magnetic valve 7 is opened for one second to initiate (or complete) the operation, and drain is discharged out. In this procedure, a carbonic acid gas magnetic valve 6 is opened, and the drain(s) is (are) discharged under suitable gas pressure (about 0.15 MPa). Discharging out at each operation may be excessively frequent, leading to waste of carbonic acid gas. Therefore, the operation time is integrated, and after each operation of four hours or more, automatic water extraction is conducted at the initiation of the next operation.

Thus, by setting the gas pressure and time corresponding to the apparatus and conducting drain extraction automatically, there is no longer a need to effect manual drain extraction purposely as in conventional technologies, and usually, effective membrane surface area is confirmed, and carbonic water having a high concentration can be produced.

EMBODIMENTS OF THE SECOND ASPECT OF THE PRESENT INVENTION

Figure 5:
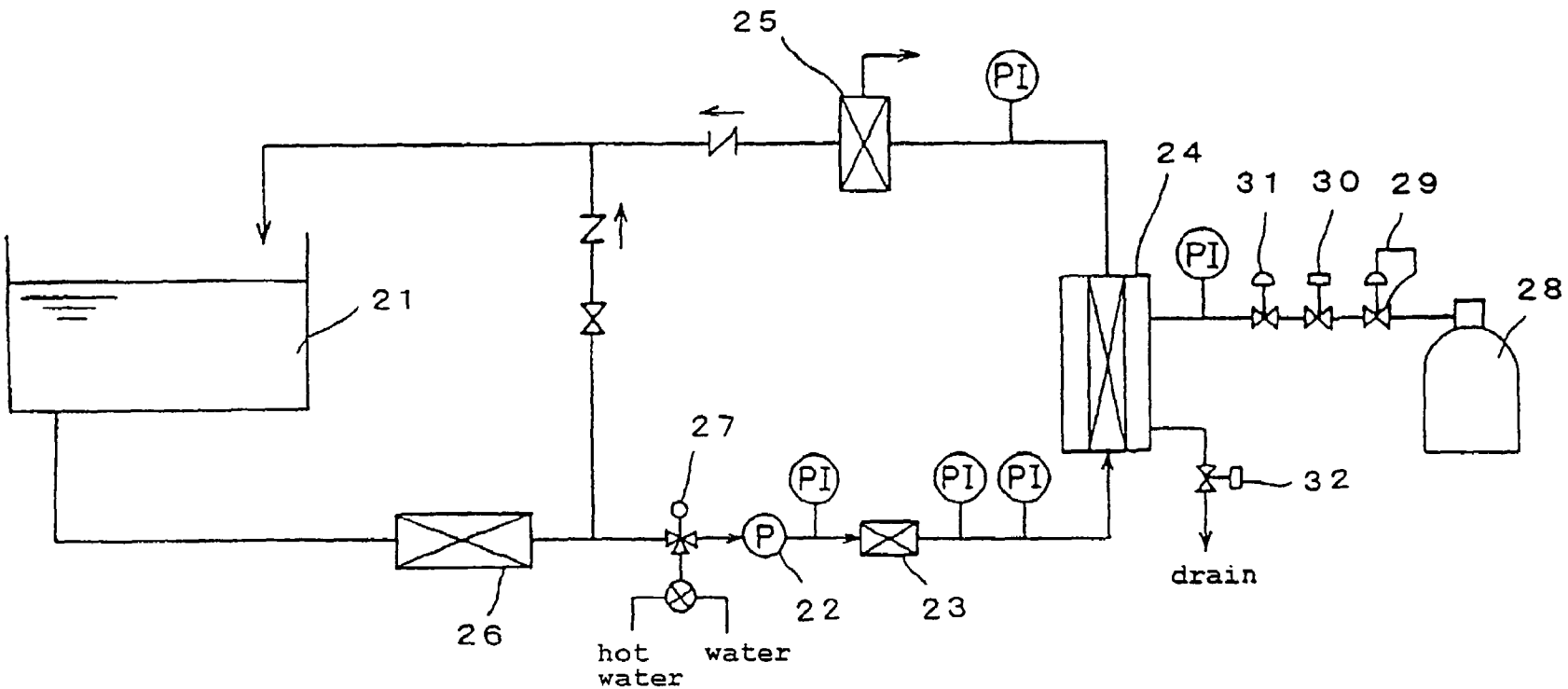
FIG. 5 is a flow sheet showing one example of using a circulation type carbonic water production apparatus according to the second aspect of the present invention.

FIG. 5 is a flow sheet showing one example of using a circulation type carbonic water production apparatus according to the second present invention.

First, an initial step in the second present invention will be explained. In the initial step, in this example, hot water in a bath (water tank) 21 is circulated. The temperature and application of water in the bath 21 in the second aspect of the present invention are the same as in the first aspect of the invention described above. In the example shown in FIG. 5, hot water in this bath 21 is sucked up by a circulation pump 22, and introduced into a carbonic acid gas dissolving apparatus 24 via a pre-filter 23 for trapping debris from the hot water, and returned again to the bath 21 through a gas extraction chamber 25. Between the bath 21 and the circulation pump 22, a filtration apparatus 26 for purifying water in the bath is provided, and additionally, a switching valve 27 through which water and hot water are fed is provided. Carbonic acid gas is fed from a carbonic acid gas cylinder 28 via a pressure-reducing valve 29, a magnetic valve 30, which is a cut off valve for carbonic acid gas, and a pressure controlling valve 31 into a carbonic acid gas dissolving apparatus 24.

The circulation pump 22, in a second embodiment of the present invention, is not particularly restricted, and a swirling pump, diaphragm pump, screw pump, tube pump, and piston pump commonly used are examples. The pressure of carbonic acid gas fed to the carbonic acid gas dissolving apparatus 24 is set by the pressure-reducing valve 25. When this pressure is lower, generation of a non-dissolved gas is suppressed, leading to enhanced dissolution efficiency. The carbonic acid gas permeation amount through a hollow fiber membrane in the carbonic acid gas dissolving apparatus 24 is in proportion to the feed pressure of the carbonic acid gas, and when the pressure is higher, the permeation amount is also higher. The amount of carbonic acid gas absorption in the circulating hot water also depends on the concentration of the carbonic acid gas and circulation water amount of the hot water, and when a carbonic acid gas greater than the absorption amount is fed, a non-dissolved gas is formed.

Regarding the carbonic water produced in the early step, its concentration of carbonic acid gas is not particularly restricted. Hot water in the bath part 21 increases in concentration of carbonic acid gas with the elapsed circulation time. When such correlation data between the circulation time and the concentration of carbonic acid gas are previously measured, if the intended concentration of carbonic acid gas and feed pressure of carbonic acid gas are determined, the necessary circulation time can be determined.

As to the preferable concentration of carbonic acid gas in carbonic water, the constitution of the carbonic acid gas dissolving apparatus 24, the constitution of a membrane module, the constitution of a hollow fiber membrane, the preferable range of the feed pressure of the carbonic acid gas, the piping for counterflow washing, and the automatic water extraction means (piping for drain discharge, magnetic valve (open valve) 32) are the same as in the case of the first aspect of the invention (FIG. 1).

Using the circulation type carbonic water production process described above, namely, by the early step in the second aspect of the present invention, carbonic water having high concentrations (for example, 600 mg/L to 1400 mg/L) can be produced efficiently. The length of time for this early step is not particularly restricted, and the step may be effected until carbonic water having the desired concentration of carbonic acid gas is filled in the bath. Usually, it is necessary to heat the water in a bath until it reaches a suitable temperature. Before use of the bath, however, it is preferable that the time (duration) of the early step in the second aspect of the present invention is also about the same as its heating time. This heating time is about one hour in the case of a large bath for a number of people.

The feed pressure of carbonic acid gas in the early step is preferably about 0.15 MPa to 0.3 MPa. Values around the lower limit of this pressure are values particularly suitable in the case of a small bath, and values around the upper limit are values particularly suitable in the case of a large bath. In the early step, the carbonic acid pressure can also be increased to produce carbonic water with a high concentration in a short period of time. However, in the concentration maintaining step, a lower pressure than this can be adopted.

Following this early step, hot water in the bath is further circulated continuously, and its high concentration is maintained efficiently, namely, the concentration maintaining step in the second aspect of the present invention is conducted. This concentration maintaining step is very significant, particularly in the case of a large bath having a large surface area on the water surface. The time (duration) of this concentration maintaining step is not particularly restricted. However, it is preferable that the concentration maintaining step is conducted during use of the bath. Furthermore, the concentration maintaining step may be effected continuously during use of the bath, or it may be effected intermittently at an interval provided that the concentration of carbonic acid gas of carbonic water in a bath can be maintained at a desired value (for example, 600 mg/L to 1400 mg/L). Since carbonic acid gas in carbonic water usually evaporates at a rate of about 1 to 4 $mg/L/cm^2/Hr$ per bath area, it may be recommended that carbonic acid gas in an amount approximately compensating its evaporation is fed and dissolved in carbonic water.

The feed pressure for carbonic acid gas in the concentration maintaining step is preferably about 0.001 to 0.1 MPa. Values around the lower limit of this pressure are values particularly suitable in the case of a small bath, and values around the upper limit are values particularly suitable in the case of a large bath.

In the second aspect of the present invention, the size of a bath (water tank) is not particularly restricted. However, a bath having an internal volume of about 0.5 $m^3$ to 3 $m^3$ can be used.

The circulation flow rate per unit area in the concentration maintaining step in the early step is preferably about 5 L/min/$m^2$ to 15 L/min/$m^2$. The carbonic acid gas permeation flow rate per unit membrane area in a hollow fiber membrane is preferably about 0.2 to 2 L/min/atm/$m^2$.

EMBODIMENTS OF THE THIRD ASPECT OF THE PRESENT INVENTION

Figure 6:
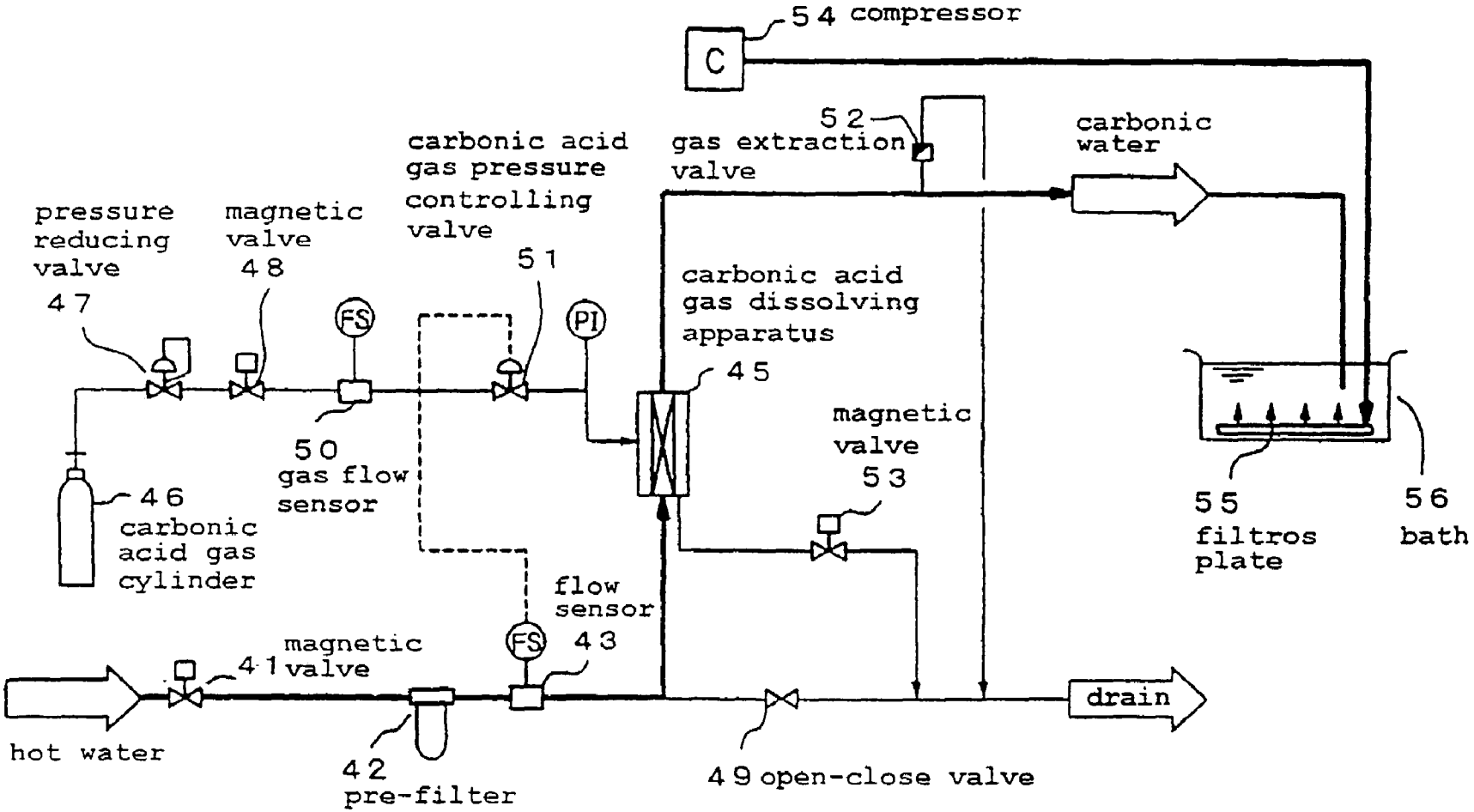
FIG. 6 is a flow sheet showing one example of using a one-pass type carbonic water production apparatus according to the third present invention.

FIG. 6 is a flow sheet showing one example of a one-pass type carbonic water production apparatus according to the third aspect of the present invention. In this example, hot water directly fed from a hot water faucet of a water line and the like is used as raw water. In the third aspect of the present invention, the temperature and application of water in a bath are the same as in the first aspect of the invention described above. The hot water is introduced into a carbonic acid gas dissolving apparatus 45 via a magnetic valve 41, which is a cut off valve in raw water feeding, a pre-filter 42 for trapping trash (debris) in the hot water and a flow sensor 43 detecting the flow rate of hot water. The carbonic acid gas is fed from a carbonic acid gas cylinder 46, via a pressure-reducing valve 47, a magnetic valve 48 which is a cut off valve for the carbonic acid gas, a gas flow sensor 50 and a carbonic acid gas pressure controlling valve 51 for controlling the carbonic acid gas pressure, into a carbonic acid gas dissolving apparatus 45. When an excess gas flows by gas leaking into the piping and the carbonic acid gas dissolving apparatus 45, the magnetic valve 48 is cut off. An apparatus for producing carbonic water by passing raw water through the carbonic acid gas dissolving apparatus 45 once is called one-pass type apparatus as illustrated above.

In this example, hot water flows continuously into a hollow part of a hollow fiber membrane in the carbonic acid gas dissolving apparatus 45. By passing through the carbonic acid gas dissolving apparatus 45, raw water becomes carbonic water, and this carbonic water is fed continuously from the carbonic acid gas dissolving apparatus 45 to a bath 56 through piping. The flow rate of the raw water fed into the carbonic acid gas dissolving apparatus 45 (namely, flow rate of raw water passing in the dissolving apparatus 45) can be detected by a flow sensor 43 provided before the raw water feed in the carbonic acid gas dissolving apparatus 45.

Figure 7:
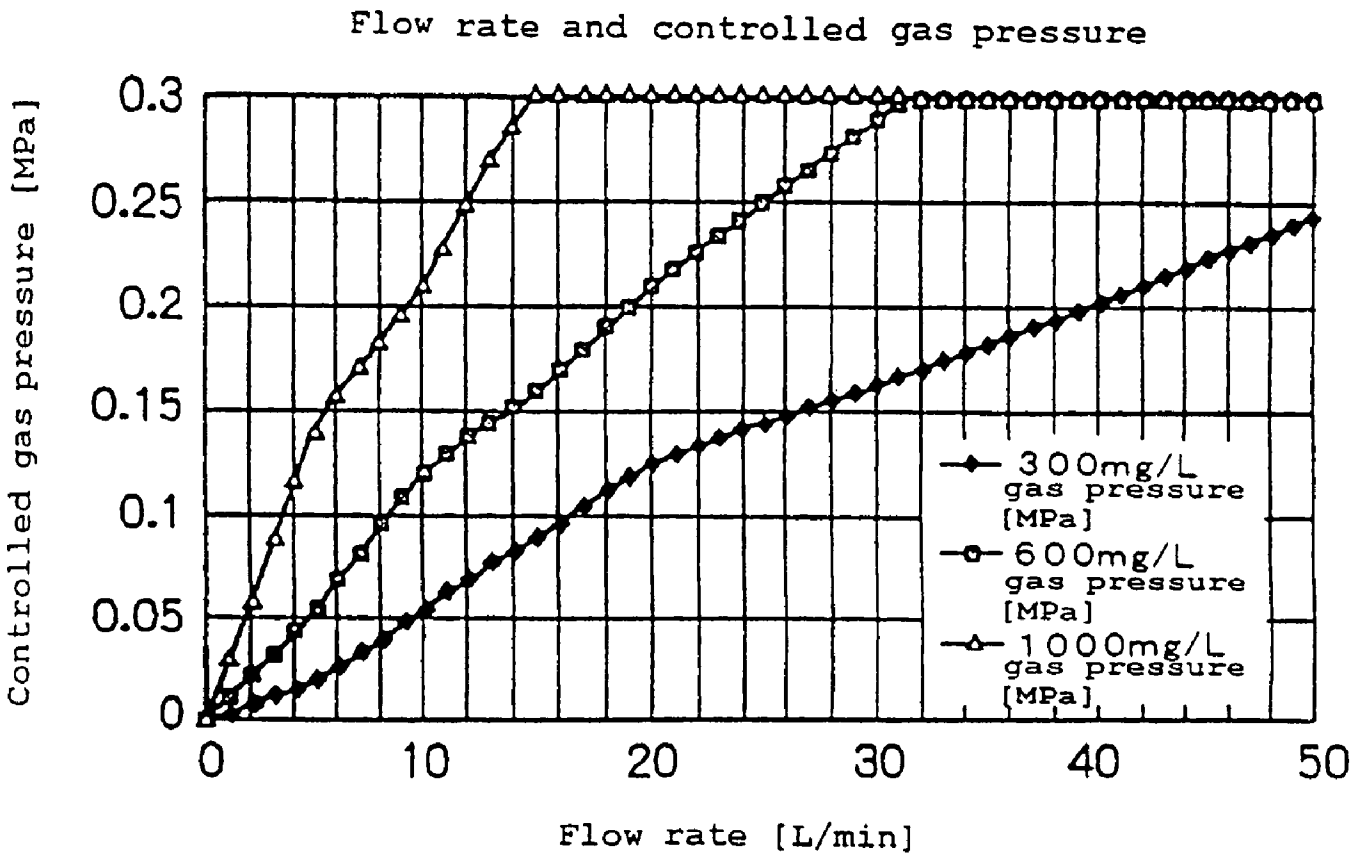
FIG. 7 is a graph showing a correlation between the flow rate of raw water and the controlled gas pressure of carbonic acid gas in the third present invention.

FIG. 7 is a graph showing a correlation between the flow rate (L/min) of the raw water flow in the carbonic acid gas dissolving apparatus 45 (hollow fiber membrane area: 2.4 $m^2$) and the controlled gas pressure (MPa) of the carbonic acid gas. In FIG. 7, a correlation between the flow rate of raw water and the controlled gas pressure of carbonic acid gas is shown when the concentration of carbonic acid gas of the resulting carbonic water is 300 mg/L, 600 mg/L and 1000 mg/L. For example, when the feed pressure of carbonic acid gas is raised, the carbonic acid gas permeation amount in a hollow fiber membrane in the carbonic acid gas dissolving apparatus 43 increases in proportion to this pressure. Therefore, when the flow rate of raw water is large or when the concentration of carbonic acid gas intended is high, the feeding pressure of carbonic acid gas may advantageously be increased correspondingly.

In the third aspect of the present invention, the correlation as shown in Table 7 is stored previously as a datum and, for example, programmed in a control computer of the apparatus. This datum is used in the following control. First, a user inputs the intended concentration of carbonic acid gas in the carbonic water to be obtained, for example, 1000 mg/L, in the apparatus. Then, hot water is fed into the apparatus from a hot water faucet of general water line. The flow rate of hot water is an indefinite factor that changes depending on the extent of opening of the faucet. Therefore, this apparatus detects the flow rate which is an indefinite factor in real time by a flow sensor 43. Based on the graph of the correlation (relative data) shown in FIG. 7, the pressure of carbonic acid gas needed to obtain carbonic water having a concentration of carbonic acid gas of 1000 mg/L is derived, and the feed pressure of carbonic acid gas fed to the carbonic acid gas dissolving apparatus 45 is automatically controlled by a carbonic acid gas pressure controlling valve 51. Namely, a program may advantageously be made so that, based on the flow rate of raw water detected by the flow sensor 43 and the relative data recorded previously, a necessary feed pressure of carbonic acid gas is determined, and the feed pressure of carbonic acid gas is automatically controlled by a carbonic acid gas pressure controlling valve 51 to reach the determined pressure value.

Regarding a hollow fiber membrane, in general, if the maximum value of the flow rate of raw water is hypothesized to be about 30 L/min, the feed pressure of carbonic acid gas is controlled in the range from 0.01 to 0.5 MPa, and the membrane area of a hollow fiber membrane is adequately from about 0.1 $in^2$ to 15 $m^2$.

In the third aspect of the present invention, for example, even in the case of feeding raw water from a faucet of water line (namely, when the flow rate of raw water is indefinite), the intended concentration of carbonic acid gas can be obtained with little error. Additionally, since a concentration of carbonic acid gas measuring means and a pH measuring means as used in conventional technologies are not necessary, the apparatus becomes compact and operation thereof is simple. Therefore, for example, providing a carbonic water production apparatus is not necessarily required in a step of designing a bath, and a compact apparatus simply corresponding to known baths including a domestic bath can be obtained, very practically.

The correlation shown in FIG. 7 is affected also by a gas-liquid contact area (e.g., hollow fiber membrane area). However, in a gas-liquid contact means such as a membrane module used in the apparatus, the gas-liquid contact area is constant. Even if a part is changed, the same product defined as the standard article of the apparatus is usually used. Namely, in an individual apparatus, usually, the gas-liquid contact area is a constant factor. Therefore, the con-elation shown in FIG. 7 will take a single meaning in one apparatus.

When a hollow fiber membrane is used in the carbonic acid gas dissolving apparatus 45, the thickness of the hollow fiber membrane is preferably from 10 to 150 μm. When the membrane thickness is 10 μm or more, sufficient membrane strength tends to be shown. When the membrane thickness is 150 μm or less, sufficient carbonic acid gas permeation speed and dissolution efficiency are liable to be shown. In the case of the three-layer complex hollow fiber membrane, the thickness of a non-porous membrane is preferably from 0.3 to 2 μm. When it is 0.3 μm or more, the membrane does not easily deteriorate, and leakage due to membrane deterioration does not occur easily. When it is 2 μm or less, sufficient carbonic acid gas permeation speed and dissolving efficiency are liable to be shown.

Constitutions other than the thickness of a hollow fiber membrane, preferable concentration of carbonic acid gas of carbonic water, constitution of the carbonic acid gas dissolving apparatus 45, constitution of a membrane module, piping for counterflow washing, automatic water extraction means (piping for drain discharge, magnetic valve (open valve) 53), bubble generating apparatus and injection apparatus are the same as in the case of the first aspect of the present invention (FIG. 1).

In the apparatus shown in FIG. 6, a gas extraction valve 52 is provided at the down flow side of the carbonic acid gas dissolving apparatus 45, namely, a the side of piping through which the produced carbonic water flows. This gas extraction valve 52 communicates with a discharge tube, and removes non-dissolved carbonic acid gas in the form of bubbles contained in the carbonic water, and discharges this gas to a drain pipe (side).

EMBODIMENTS OF THE FOURTH ASPECT OF THE PRESENT INVENTION

As the embodiment of the fourth aspect of the present invention, namely, a carbonic water production apparatus having an automatic water extraction means, which automatically discharges drain collected in a membrane type carbonic acid gas dissolving apparatus out of the apparatus, there may be mentioned, for example, the one-pass type carbonic water production apparatus shown in FIG. 6 as explained previously as the embodiment of the third aspect of the present invention. However, in the fourth aspect of the present invention, a means of controlling the feed pressure of carbonic acid gas as described in the third aspect of the present invention is not necessarily required. Excepting these points, constitutions as described in FIG. 6 can be adopted.

Namely, in the apparatus shown in FIG. 6, an automatic water extraction means is provided. This automatic water extraction means is composed, specifically, of piping for extracting drain communicating with the outer side of a hollow fiber membrane in the carbonic acid gas dissolving apparatus 45 and a magnetic valve (open valve) 53 placed along the piping. In the carbonic acid gas dissolving apparatus 45, water vapor evaporated from a hollow part of a hollow fiber membrane is condensed on the outside part of a hollow fiber membrane to collect the drain. This drain clogs the membrane surface and effective gas permeation cannot be effected in some cases. The automatic water extracting means opens the magnetic valve (open valve) 53 automatically and periodically, and discharges drain collected in the carbonic acid gas dissolving apparatus 45 out of the apparatus. In the example shown in FIG. 6, for example, the setting can be such that when the follow rate of raw water detected by the flow sensor 43 is 1 L/min or less, the magnetic valve 48 closes to stop feeding carbonic acid gas, whereby production of carbonic water is stopped. The setting is made so that, after feeding of carbonic acid gas is thus stopped, a given (certain) time elapses. Then the drain is automatically extracted. Specifically, 10 seconds after this the gas feed is stopped, the magnetic valve 53 is opened for about five seconds, and the drain is discharged using the remaining pressure of gas in the hollow fiber membrane(s).

The carbonic acid gas dissolving apparatus may have a constitution in which carbonic acid gas is fed in a hollow fiber membrane and raw water flows to the outside of a hollow fiber membrane, contrary to the above-mentioned constitution. In the case of such a constitution, drain extracting piping in communion with the inside of a hollow fiber membrane in the carbonic acid gas dissolving apparatus.

When stopping the feed of carbonic acid gas, there is a possibility that a high pressure of 0.3 MPa at its maximum remains as a remaining pressure in the outside of a hollow fiber membrane in the carbonic acid gas dissolving apparatus 45. Therefore, if the magnetic valve 53 is opened directly after stopping the feed of carbonic acid gas, a hammer phenomenon may occur. To prevent this, a time lag (about 10 seconds) is provided in the above-mentioned example. With a last time of about 10 seconds, a gas outside of a hollow fiber membrane permeates appropriately into the hollow side via the membrane, and the remaining pressure outside of a hollow fiber membrane becomes about 0.05 MPa. At such a remaining pressure, a hammer phenomenon does not occur, and drain can be discharged sufficiently only by opening the magnetic valve 53 for about 5 seconds.

In a carbonic water production apparatus, raw water and carbonic acid gas are fed into the membrane type carbonic acid gas dissolving apparatus 45 to dissolve carbonic acid gas in raw water as shown in FIG. 6. The setting is made so that, in stopping the feed of carbonic acid gas, after an elapsed time (lag time) in which the remaining pressure outside of a hollow fiber membrane in the carbonic acid gas dissolving apparatus 5 permeates to the hollow side to a certain extent and drain can be appropriately discharged, the valve is opened for a sufficient period of time for extracting drain, automatically. This time lag may be advantageously set so that, particularly, the remaining pressure is preferably about 0.02 to 0.05 MPa, more preferably about 0.02 to 0.03 MPa. Specifically, a suitable time lag is about 5 to 10 seconds. The duration of time that the magnetic valve 53 is opened is appropriately from about three to five seconds.

Furthermore, as another embodiment of the fourth aspect of the present invention, there may be mentioned, for example, a constitution of the circulation type carbonic water production apparatus shown in FIG. 1 as explained previously in connection with the embodiment of the first aspect of the present invention. However, in the fourth aspect of the present invention, a positive displacement metering pump having a self-priming ability as in the first aspect of the present invention is not necessarily required. Except for these points, constitutions (arrangements) as described in FIG. 1 can be adopted.

Namely, in the apparatus shown in FIG. 1, the automatic water extraction means is composed, specifically, of piping for extracting drain in a hollow fiber membrane in the carbonic acid gas dissolving apparatus 3 and a magnetic valve (open valve) 7 placed along the piping. This automatic water extracting means opens the magnetic valve (open valve) 7 automatically and periodically, and discharges drain collected in the carbonic acid gas dissolving apparatus 3 out of the apparatus. For example, in the carbonic acid gas dissolving apparatus 3 (hollow fiber membrane area: 0.6 $m^2$), the magnetic valve 7 is opened for one second in initiation of operation (or in completion), and the drain is discharged out. In this procedure, carbonic acid gas magnetic valve 6 is opened, and drain(s) is (are) discharged under suitable gas pressure (about 0.15 MPa). Discharging out at each operation may be excessively frequent, leading to waste of a carbonic acid gas. Therefore, the operation time is integrated, and after each operation for four hours or more, automatic water extraction is conducted at the initiation of the next operation.

In a carbonic water production apparatus shown in FIG. 1 (circulation type) of circulating water in the bath 11 (water tank) via the carbonic acid gas dissolving apparatus 3 by the circulation pump 1 and feeding carbonic acid gas into the carbonic acid gas dissolving apparatus 3 to dissolve the carbonic acid gas in water, the setting is made such that at initiation or completion of operation, the valve is opened for a sufficient time in order to extract drain, automatically, while supplying a suitable pressure for extracting drain from a carbonic acid gas feeding tube. This suitable pressure is preferably about 0.03 to 0.15 MPa. The duration of time the magnetic valve 7 is opened is suitably about one to five seconds. Further, the setting may advantageously be made so that the operation time of the carbonic acid gas dissolving apparatus 3 and the drain remaining extent are recorded as data, and the length of time required for drain extraction (integrated operation time) is determined, and the operation time is automatically integrated by the apparatus, and after each operation for the integrated operation time of more, automatic water extraction is conducted at the initiation (beginning) of the next operation. This integrated operation time is preferably about four to six hours.

Thus, by setting the time and the remaining pressure corresponding to the apparatus and conducting drain extraction automatically, there is no necessity to effect manual drain extraction purposely as in conventional technologies, and usually, effective membrane surface area is confirmed, and carbonic water of high concentration can easily be produced.

EMBODIMENTS OF FEEDING TO A PLURALITY OF USE POINTS IN THE FIRST TO THE FOURTH ASPECTS OF THE PRESENT INVENTIONS

In the first through fourth aspects of the present inventions as described above, another useful embodiment is an application in which an apparatus in which a carbonic water production apparatus and a water storage tank are provided, carbonic water produced in the carbonic water production apparatus is stored in the water stored tank, and carbonic water stored in the water storage tank is fed to a plurality of use points by a water conveying pump.

In conventional carbonic water production, it is usual for one carbonic water production apparatus to be used for one use point (e.g., bath). Therefore, in facilities, such as hospitals and sanatoriums that can have a lot of use points, a carbonic water production apparatus should be provided for each use point, which necessarily result in increased equipment costs. Furthermore, use of one carbonic water production apparatus for one use point means that when a large amount of carbonic water is necessary at a time for the use point, a dissolving apparatus and the like in the carbonic water production apparatus must be enlarged. On the other hand, in the case of application to a carbonic water production feeding system having separated functions for producing carbonic water and for storing water, together (carbonic water production apparatus) as described above, even if carbonic water is fed to a plurality of use points, one carbonic water production apparatus can act satisfactorily, which can lead to reduced equipment costs.

Figure 8:
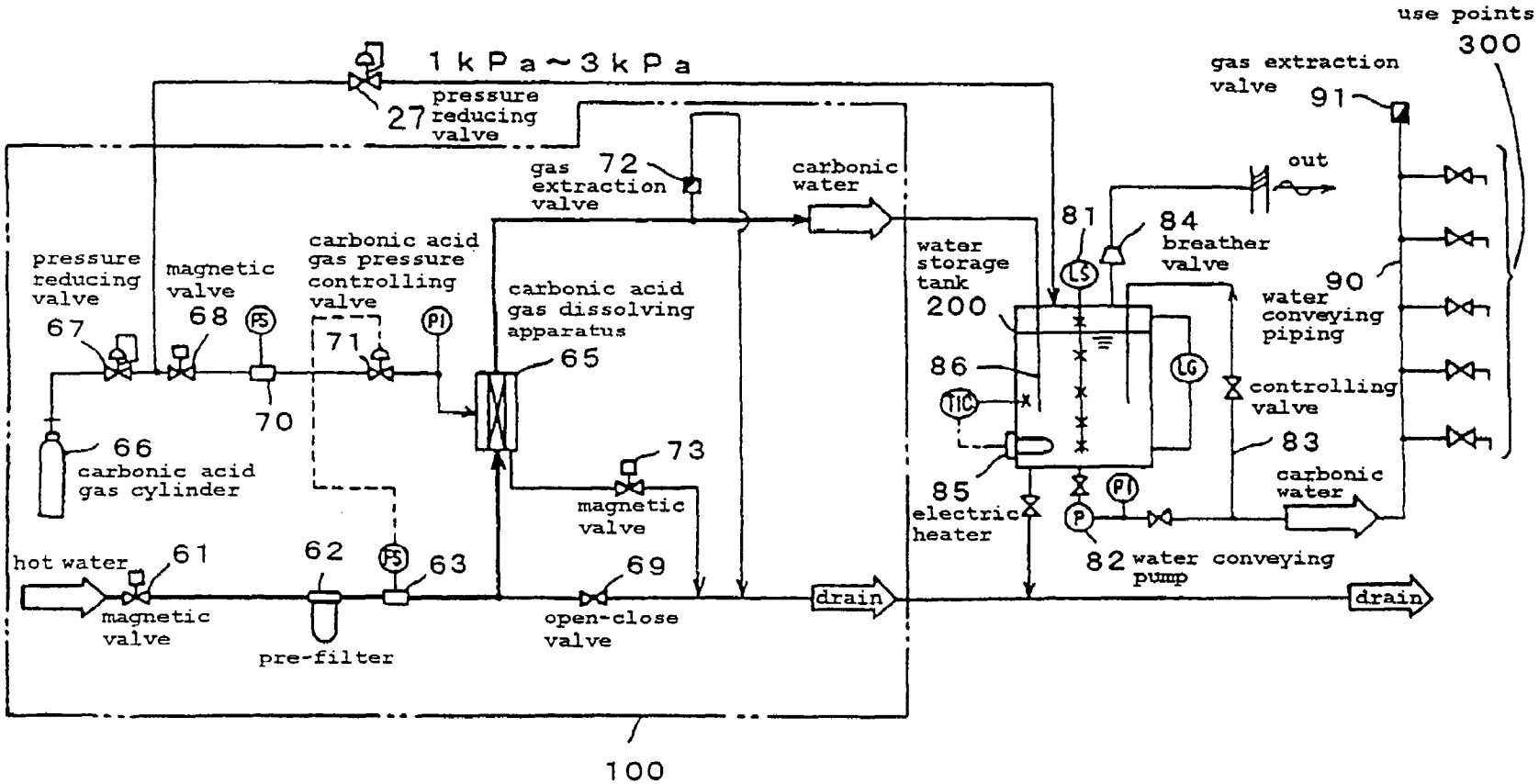
FIG. 8 is a flow sheet schematically showing one example of application to a carbonic water production and feeding system.

FIG. 8 is a flow sheet schematically showing one example of this embodiment. This apparatus comprises a carbonic water production apparatus 100 and a water storage tank 200 as the basic elements. The carbonic water production apparatus 100 is a one-pass type apparatus, and in this example, hot water directly fed from a hot water faucet of water line and the like is used as raw water. This hot water is introduced into a carbonic acid gas dissolving apparatus 65 via a magnetic valve 61, which is a cut off valve in raw water feeding, a pre-filter 62 for trapping trashes in the hot water and a flow sensor 63 detecting the flow rate of hot water. On the other hand, a carbonic acid gas is fed from a carbonic acid gas cylinder 66, via a pressure-reducing valve 67, a magnetic valve 68 which is a cut off valve for a carbonic acid gas, a gas flow sensor 70 and a carbonic acid gas pressure controlling valve 71 for controlling the carbonic acid gas pressure, into a carbonic acid gas dissolving apparatus 65. It has also an automatic water extraction means (drain extraction piping, and a magnetic valve (opening valve) 73 placed along the piping) and a gas extraction valve 72.

Next, the water storage tank 200 and use points 300 are described.

Carbonic water having a high concentration (about 1000 mg/L) produced in the above-mentioned carbonic water production apparatus 100 is fed to the water storage tank 200 through piping. A feeding tube 86 for feeding the produced carbonic water to the water storage tank 200 is placed as an insertion tube in the water storage tank 200. By this, stirring of carbonic water can be prevented as completely as possible and evaporation of carbonic acid gas from the carbonic water can be prevented. When water in the water storage tank 200 reaches a given water level, carbonic water production in the carbonic water production apparatus 100 is stopped by a level switch 81.

Next, carbonic water is fed centrally to use points 300 by a water conveying pump 82. A gas extracting valve 91 is mounted on the uppermost part of a water conveying tube 90, to remove the evaporated carbonic acid gas.

Examples of a suitable, commonly used water conveying pump 82 include, for example, a swirling pump, a diaphragm pump, a screw pump, a tube pump and a piston pump. To aid in driving the water conveying pump 82, return piping 83 is provided for causing constant circulation, for preventing shutoff of the water conveying pump 82, and for controlling the water conveying flow rate. A part of this return piping 83 contributes to re-conveying to the water storage tank 200 and is placed as an insertion tube like the feeding tube 86 for feeding carbonic water to the water storage tank 200, and is used to prevent stirring of carbonic water as completely as possible.

Here, if the water storage tank 200 is an open system, there is a tendency for carbonic acid gas in the carbonic water to vaporize when at a lower concentration. Therefore, to maintain a high concentration of carbonic water in the water storage tank 200, it is preferable that a gas phase part in the tank is always filled with a carbonic acid gas. In the example shown in FIG. 8, a carbonic acid gas of about 1 kPa to 3 kPa is sealed and pressed as a gas phase in the water storage tank 200 via a pressure-reducing valve 87 from carbonic acid gas cylinder 66. According to this constitution, when the water level of carbonic water in the water storage tank 200 lower, a carbonic acid gas is fed into the gas phase, and when the water revel rises, discharge is effected through a breather valve 84.

The water storage tank 200 has an electric heater 85 which maintains the temperature of carbonic water at given temperature. The electric heater 85 is turned on or off by a controller.

In the water storage tank 200, if the gas pressure in the gas phase part and the temperature of carbonic water are determined, the dissolution degree of carbonic acid gas in water is constant, and therefore, the carbonic water is always maintained at a constant concentration and can be stored in the water storage tank 200. For example, when a gas phase part is composed of 100% carbonic acid gas under atmospheric pressure, the dissolution degree of carbonic acid gas in water (40?C) is chemically 1109 mg/L (40?C). Therefore, the concentration of carbonic acid gas in carbonic water can be kept at a high concentration of 1000 mg/L or more only by maintaining a gas phase part (carbonic acid gas) at atmospheric pressure. Additionally, if the atmosphere in the water storage tank 200 is maintained at or around the atmospheric pressure, extreme positive pressure or negative pressure is not applied on the wall part of the water storage tank 200. Therefore, the structural material of the water storage tank 200 may be made of a relatively light material, which means reduced equipment costs.

In this embodiment, water fed to the water storage tank 200 should be carbonic water of a desired concentration. If water containing utterly no carbonic acid gas is fed to the water storage tank 200, for example, it is necessary to carry out a conventional method (pressured method) in which pressure sealing is effected in the water storage tank 200 under high pressure, to produce a carbonic acid gas. However, in this case, the water storage tank 200 is enlarged, and a longer period of time is necessary for production of carbonic water, therefore, stable feeding to use points can not be performed. Additionally, it is also difficult to obtain carbonic water having desired high concentration.

EMBODIMENTS OF THE FIFTH ASPECT OF THE PRESENT INVENTION

Figure 9:
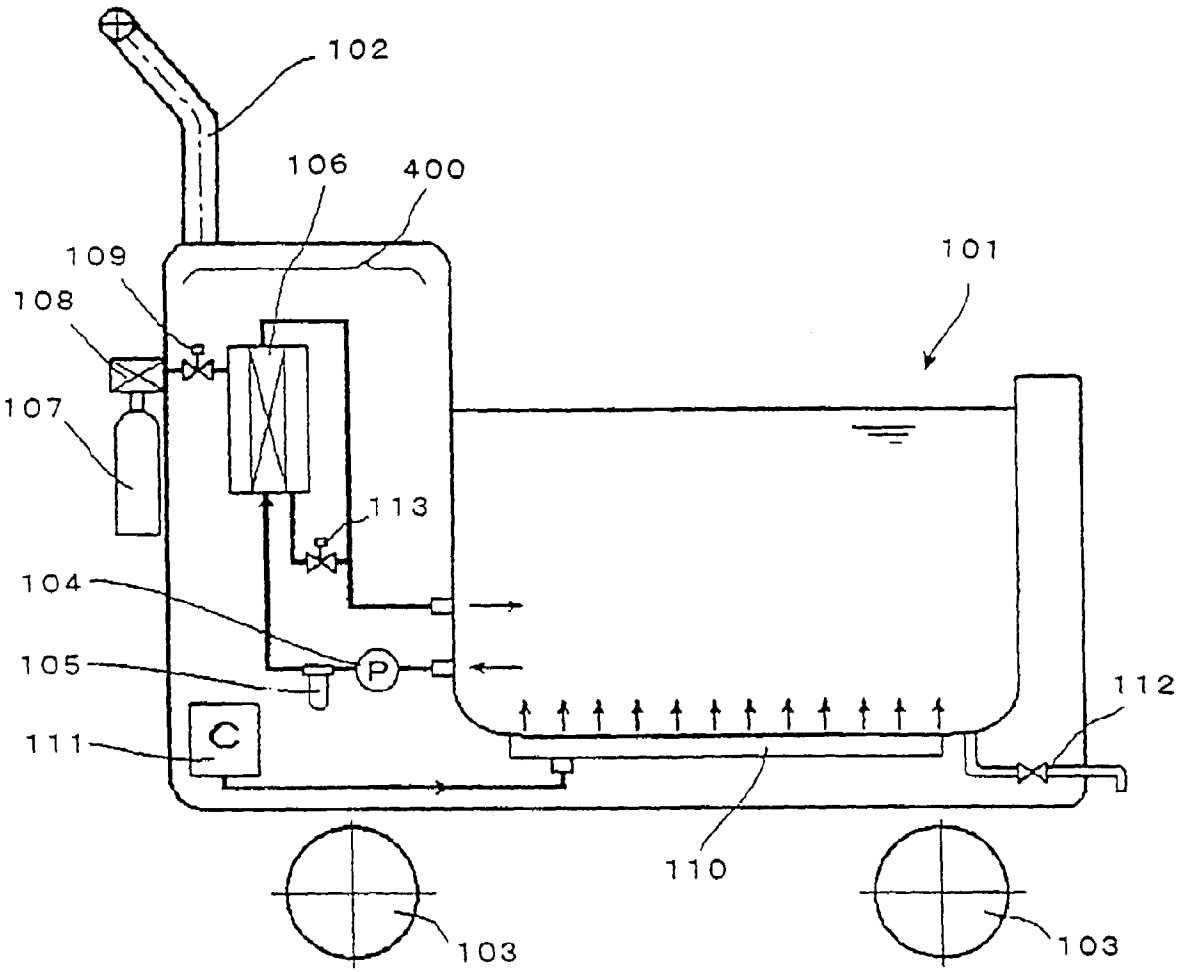
FIG. 9 is a schematic view showing one embodiment of the fifth aspect of the present invention utilizing a circulation type carbonic water production apparatus.

FIG. 9 is a schematic view showing one embodiment of the fifth present invention using a circulation type carbonic water production apparatus 400. This apparatus contains a carbonic water production apparatus 400 at the posterior side of a bath part 101. On its posterior upper side, a handle 102 is mounted, and casters 103 are provided under the body. This handle 102 and casters 103, make easy conveyance possible. In this example, as the carbonic water production apparatus 400, a circulation type apparatus is used, and hot water in a bath part 101 is circulated. In the fifth aspect of the present invention, the temperature of water in the bath part 101 is not particularly restricted. However, temperatures around body temperature or lower are preferable, to manifest physiological effects of carbonic water and so as not to apply surplus load on a diseased part. Specifically, temperatures of about 32° to 42?C are preferable.

In the example shown in FIG. 9, hot water in this bath part 1 is absorbed by a circulation pump 104, and introduced into a carbonic acid gas dissolving apparatus 106 via a pre-filter 105 for trapping trash (debris) from the hot water and returned again to the bath part 101. On the other hand, carbonic acid gas is fed from a carbonic acid gas cylinder (or cartridge) 107, via a pressure-reducing valve 108 and a magnetic valve 109 which is a cut off valve for a carbonic acid gas, into a carbonic acid gas dissolving apparatus 106. The circulation pump 104 is not particularly restricted, and can be, for example, a swirling pump, a positive displacement metering pump, and the like, which are commonly used. Since the apparatus according to the fifth aspect of the present invention is an integrated type in which the bath itself has a carbonic water production apparatus, for example, the circulation pump 104 can be placed at a position lower than the bottom of the bath. With such a layout, a pump can be activated even if no priming is effected on the pump. Namely, in a circulation type carbonic water production apparatus, a commonly used swirling pump can be used, which is also one of the advantages of the fifth aspect of the present invention.

The carbonic acid gas dissolving apparatus 106 is a membrane type carbonic acid gas dissolving apparatus having a membrane module containing a hollow fiber membrane placed in it. In this example, when hot water in the bath part 101 is circulated for any amount of time by the circulation pump 104, the bath part 101 will be filled with carbonic water having a high concentration of carbonic acid gas. The volume of this bath part 101 is usually in the range from 10 to 40 L.

In the case of a foot bath, utilizing the circulation type carbonic water production apparatus 400 as shown in FIG. 9, namely, an apparatus which comprises the carbonic acid gas dissolving apparatus 106 and circulation pump 104, in which carbonic acid gas is fed into the carbonic acid gas dissolving apparatus 106 while circulating water in the bath part 101 via the carbonic acid gas dissolving apparatus 106 by the circulation pump 104, to dissolve the carbonic acid gas in water, to produce carbonic water, leads to advantages in operating costs, as compared with a foot bath (see FIG. 10 described later) utilizing a one-pass type carbonic water production apparatus.

Further, in this example, when the amount of water passed per hollow fiber membrane module is 0.1 to 10 L/min and the gas pressure is 0.01 MPa to 0.3 MPa, it is preferable that the membrane area is about 0.1 $m^2$ to 5 $m^2$.

In the foot bath shown in FIG. 9, when carbonic water is produced as described above and this apparatus is used as a foot bath, then the carbonic water used is extracted from the discharge tube 102, and the inner surface of the bath is washed in preparation for a subsequent use. Use of the same carbonic water for a plurality of patients is not preferable due to a possibility of bacterial infection. From the standpoint of shortening the discharge operation time, it is preferable that the internal diameter of the discharge tube 112 is 20 mm or more. In the example shown in FIG. 9, a bubble generation apparatus is mounted to provide one unit package, to give a multi-functional apparatus. The bubble generating apparatus is composed of, at least, a gas diffusing part 110 placed at the lower side of a bath part 1, a compressor 111 for feeding air to the gas diffusing part 110, and piping connecting both of them. By activating the compressor 111, bubbles are generated from the gas diffusing part 110, and a physical stimulation is imparted to a diseased part of the patient.

In the example shown in FIG. 9, automatic water extraction means (i.e., piping for drain discharge and magnetic valve (open valve) 113) are further provided. In the case of a circulation type apparatus, it may be recommended that the magnetic valve 113 is opened for one second in initiation of operation (or in completion), and the drain is discharged out under suitable gas pressure. The preferred concentration of carbonic acid gas of carbonic water, constitution of the carbonic acid gas dissolving apparatus 106, constitution of the membrane module, constitution of the hollow fiber membrane, and a preferred range of carbonic acid gas feeding pressure, piping for counterflow washing and automatic water extraction means (i.e., piping for drain discharge and magnetic valve (open valve) 113) are the same as in the case of the first aspect of the present invention (FIG. 1).

Figure 10:
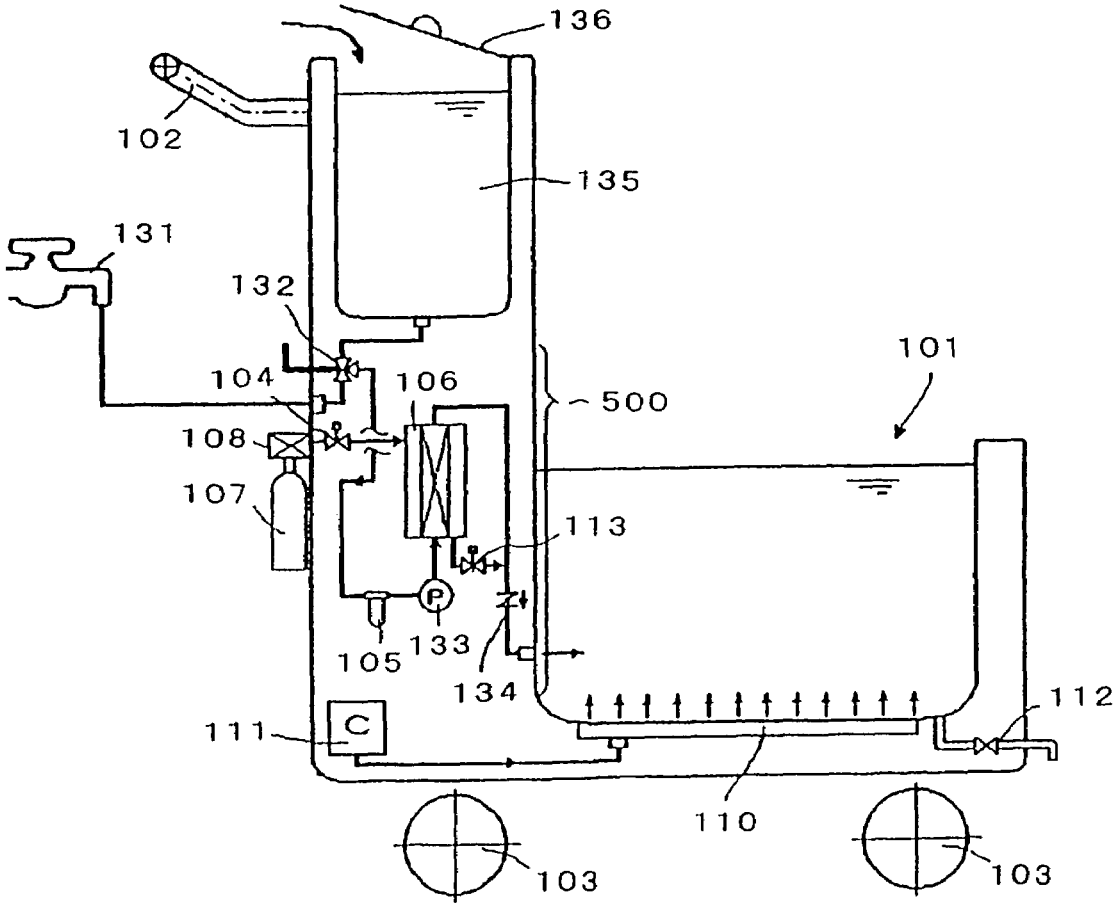
FIG. 10 is a schematic view showing one embodiment of the fifth present invention utilizing a one-pass type carbonic water production apparatus.

FIG. 10 is a schematic view showing one embodiment of the fifth present invention using a one-pass type carbonic water production apparatus 500. In this example, hot water directly fed from a hot water faucet 131 on a water line and the like is used as raw water. This hot water is introduced into a carbonic acid gas dissolving apparatus 106 via a switching valve 132 for cutting off and switching the raw water feed, a pre-filter 105 for trapping trash (debris) in the hot water and a pump 133. On the other hand, carbonic acid gas is fed from a carbonic acid gas cylinder (or cartridge) 107, via a pressure-reducing valve 108 and a magnetic valve 109 which is a cut off valve for a carbonic acid gas, into a carbonic acid gas dissolving apparatus 106. There is no need to use a special pump as the pump 133, and for example, commonly used pumps such as a swirling pump and the like are suitable. However, the pump 133 is not necessarily required in a one-pass type apparatus. Namely, if desired water pressure is obtained from the use of tap water and the like, carbonic water can be produced by passing water to the apparatus 500 without using the pump 133. For the carbonic acid gas cylinder (or cartridge) 107, a small cylinder is preferable from the standpoint of conveyance, and a cylinder (or cartridge) having a volume of 1 L or less is preferable.

Furthermore, instead of using tap water, water stored in a water storage tank 135 provided on the carbonic water production apparatus 500 can also be fed (a flow) into the carbonic acid gas dissolving apparatus 106 via the switching valve 132. The volume of the water storage tank 135 is the same as that of the bath part 101 of the foot bath, and hot water is collected in the water storage tank 135 in every operation, the whole amount is fed to the bath part 101 via the carbonic water production apparatus 500. By such means, a foot bath can be used even at a place where there is no water line, and the advantage of a portable foot bath can be further utilized. Raw water in the water storage tank 135 has been previously fed over a suitable time by opening a lid 136.

The carbonic acid gas dissolving apparatus 106 is a membrane type carbonic acid gas dissolving apparatus having a membrane module containing a hollow fiber membrane placed in it. In this example, a carbonic acid gas fed into the carbonic acid gas dissolving apparatus 106 is introduced onto the outer surface of the hollow fiber membrane. The raw water (hot water) fed into the carbonic acid gas dissolving apparatus 106 flows in a hollow part of the hollow fiber membrane. Here, the carbonic acid gas on the outer surface of the hollow fiber membrane comes into contact with raw water flowing in a hollow part of the hollow fiber membrane via a membrane surface. The carbonic acid gas is dissolved in raw water to produce carbonic water having a desired concentration in one pass. This carbonic water is fed into the bath part 101 via a non-return valve.

The carbonic acid gas dissolving apparatus may have a constitution in which a carbonic acid gas is fed into a hollow fiber membrane and raw water flows to the outside of a hollow fiber membrane, contrary to the above-mentioned constitution.

A foot bath utilizing the one-pass type carbonic water production apparatus 500 as shown in FIG. 10, namely, an apparatus which comprises the carbonic acid gas dissolving apparatus 106 and in which carbonic acid gas is fed into the carbonic acid gas dissolving apparatus 106 from either a raw water feeding port in communication with a faucet 131 or a water storage tank 136 while raw water flows thereby dissolving the carbonic acid gas to produce carbonic water, means that microbial infection in the apparatus does not occur easily, as compared with a foot bath utilizing the circulation type carbonic water production apparatus 400 shown in FIG. 9. When the one-pass type carbonic water production apparatus 500 is used, carbonic water production time can be shortened as compared with the case of use of a circulation type apparatus, and the apparatus 500 is very useful, for example, when treatment of a number of patients is necessary.

In automatic water extraction (drain extraction) in FIG. 10, after stopping the feed of carbonic acid gas and after a given time lapse (for example, after 10 seconds), a magnetic valve 73 is opened for five seconds, and drain is discharged out by the remaining gas.

In the examples shown in FIGS. 9 and 10, the carbonic water production apparatuses 400 and 500 are preferably detachable from the body of the foot bath from the standpoints of maintenance, expendable item exchange, and the like. Specifically, it may be recommended that it be integrated into a panel composed of angles to make a unit in the form of a box (skid) which can be removed simply.

The carbonic water production apparatuses equipped with foot baths as shown in FIGS. 9 and 10 described above are of a very suitable form for a carbonic water production apparatus, since the bath and gas cylinder are integrated into a unit. Portability is obtained, and carbonic water bathing can be carried out simply without being restricted to a selected, permanent, fixed location. Patients utilizing foot baths often have ischemic ulcers due to peripheral blood cell circulation deficiency and often use a wheel chair. Therefore, it is preferred that an apparatus of the present invention also have a size corresponding to a wheel chair. For example, a wheel chair is usually equipped with foot rests. It is convenient in foot-bathing for these foot rests to be lifted on both sides, so that a foot bath can be inserted into the wheel chair. In this case, the width of a foot bath should be not more than the inner size when foot rests are lifted at both sides. Therefore, specifically, the width of a foot bath is preferably from about 300 to 350 mm. For example, the height and depth of a foot bath can advantageously be set so that patients in a wheel chair can insert their feet into the foot bath easily and the feet can be bathed as deeply as possible. Therefore, specifically, the height of a foot bath is preferably from about 350 to 450 mm, and the depth of a bath is preferably from about 250 to 350 mm.

The present invention will be illustrated further by examples below.

First, Example A regarding the first aspect of the present invention will be described.

EXAMPLE A1

Using the apparatus shown in the flow sheet of FIG. 1, carbonic water was produced as described below. For the carbonic acid gas dissolving apparatus 3, a dissolving apparatus was used containing the three-layer complex hollow fiber membrane described above (manufactured by Mitsubishi Rayon Co., Ltd., trade name: MHF) at an effective total membrane area of 0.6 $m^2$, and a carbonic acid gas was fed on the outer surface side of the hollow fiber membrane and raw water was fed to the hollow side, to dissolve the carbonic acid gas. As the circulation pump 1, a 3-head diaphragm pump manufactured by SHURflo, a diaphragm mode metering pump, was used.

Hot water having an amount of 10 L and a temperature of 35?C filled in the bath 11 was circulated at a flow rate of 5 L/min by the circulation pump 1, and simultaneously, a carbonic acid gas was fed under a pressure of 0.05 MPa to the carbonic acid gas dissolving apparatus 5. By this circulation, the concentration of carbonic acid gas in hot water in the bath 11 increased gradually. The concentration of carbonic acid gas was measured by an ion meter (brand IM40S manufactured by Toa Denpa Kogyo K.K.), and a carbonic acid gas electrode brand CE-235. The measurement results of the concentration of carbonic acid gas at every circulation time are shown in Table 1. In production of carbonic water, drain extraction was conducted automatically by an automatic water extraction function, and gas extraction was appropriately conducted.

Figure 4:
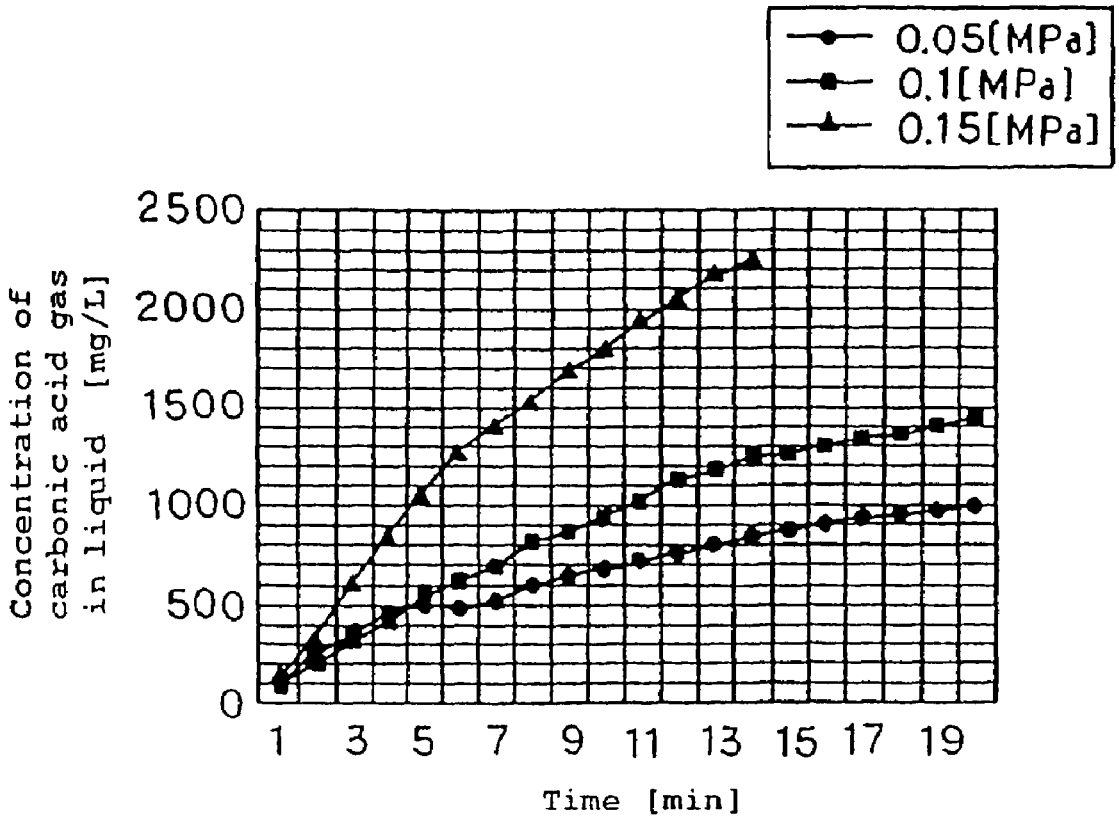
FIG. 4 is a graph showing a correlation between the circulation time and the concentration of carbonic acid gas in Example A1.

Further, carbonic water was produced in the same manner except that the feed pressure of the carbonic acid gas was changed to 0.10 MPa and 0.15 MPa. The circulation time and the concentration of carbonic acid gas in this case are also shown in Table 2. These are shown in the form of a graph in FIG. 4.

TABLE 1

| Correlation of circulation time and concentration of carbonic acid gas | | | |
|---|---|---|---|
| | Concentration of carbonic acid gas [mg/L] | | |
| Circulation time. min | Gas feed pressure 0.05 MPa | Gas feed pressure 0.1 MPa | Gas feed pressure 0.15 MPa |
| 1 | 119 | 94 | 92.8 |
| 2 | 254 | 200 | 335 |
| 3 | 358 | 319 | 607 |
| 4 | 437 | 428 | 848 |
| 5 | 499 | 548 | 1057 |
| 6 | 490 | 623 | 1265 |
| 7 | 521 | 697 | 1410 |
| 8 | 594 | 814 | 1531 |
| 9 | 648 | 873 | 1699 |
| 10 | 691 | 945 | 1802 |
| 11 | 721 | 1029 | 1937 |
| 12 | 763 | 1135 | 2050 |
| 13 | 812 | 1189 | 2190 |
| 14 | 839 | 1250 | 2260 |
| 15 | 883 | 1270 | |
| 16 | 912 | 1308 | |
| 17 | 932 | 1351 | |
| 18 | 949 | 1372 | |
| 19 | 976 | 1406 | |
| 20 | 1008 | 1447 | |

Based on the data shown in Table 1, for example, if the intended concentration of the carbonic acid gas to be produced is 1000 mg/L, the desired times for circulation are determined as shown in Table 2 for feed pressures of carbonic acid gas at 0.05 MPa, 0.10 MPa and 0.15 MPa, respectively.

TABLE 2

| Feed pressure of carbonic acid gas | Concentration of carbonic acid gas | Necessary time |
|---|---|---|
| 0.05 MPa | 1008 mg/L | 20 min. |
| 0.10 MPa | 1029 mg/L | 11 min. |
| 0.15 MPa | 1057 mg/L | 5 min. |

In the first aspect of the present invention, since a positive displacement metering pump having a self-priming ability is used, carbonic water having a high concentration of about 1000 mg/L can also be circulated stably. Therefore, when water was again circulated for the desired times under three gas feed pressures shown in Table 2, carbonic water having a high concentration of about 1000 mg/L could be produced.

COMPARATIVE EXAMPLE A1

Carbonic water was attempted to be produced in the same manner as in Example A1 except that a swirling pump was used instead of a diaphragm type metering pump, as the circulation pump 1, and an under-water pump (swirling mode) was attached also at the tip of an absorption hose in a bath to provide the pressure at a pump absorption port positive (pushing). However, before reaching carbonic water (1000 mg/L) of high concentration, the pump stopped due to generation of bubbles.

The time from initiation of operation until the swirling pump is stopped due to the bubble entrainment, and the concentration of carbonic acid gas at its stopping point are shown in Table 3.

TABLE 3

| Feed pressure of carbonic acid gas | Stop time | Reached concentration |
|---|---|---|
| 0.05 MPa | 12 min. | 624 mg/L |
| 0.10 MPa | 4 min. | 750 mg/L |
| 0.15 MPa | 3 min. | 678 mg/L |

From the results shown in Table 3, it is known that, when a swirling pump is used, the concentration of carbonic water increases and the pump is stopped by entrained bubbles. Consequently, a high concentration of about 1000 mg/L cannot be produced.

As described above, in the first aspect of the present invention, since a positive-displacement metering pump is used, even if bubbles are generated in carbonic water having a high concentration, stable circulation is possible. In addition, complicated control is not necessary, the constitution (construction) of the apparatus can be simplified significantly, the apparatus has small size and a low cost, and carbonic water of high concentration can be produced by a simple operation at low cost. Furthermore, as compared with a one-pass type apparatus, setting is simple, and carbonic water can be produced more efficiently at low cost at a low gas feed pressure. From such a standpoint, the first aspect of the present invention is very useful as a domestic carbonic water production apparatus since, for example, it can be used merely by filling a bath with hot water and putting a carbonic water circulation hose of the apparatus.

Next, Example B regarding the second present invention will be described.

EXAMPLE B1

The carbonic water production process according to the second present invention shown in FIG. 5 was carried out as described below.

As the carbonic acid gas dissolving apparatus 24, a dissolving apparatus was used containing the three-layer complex hollow fiber membrane described above (manufactured by Mitsubishi Rayon Co., Ltd., trade name: MHF) at an effective total membrane area of 2.4 $m^2$, and a carbonic acid gas was fed on the outer surface side of the hollow fiber membrane and raw water was fed to the hollow side, to dissolve the carbonic acid gas. As the filtration apparatus 26, an RAF-40N brand apparatus (trade name, manufactured by Noritz Corp., ability: 4 t/H (67 L/min), 400 W) was used, as the circulation pump 22, a commonly used swirling pump (270 W) was used, and as the bath 21, a large bath having a volume of 1000 L (1 $m^3$) was used. An early step was carried out at a water temperature of 40?C, a circulation flow rate of 10 L/min/$m^2$ and a carbonic acid gas pressure of 0.2 MPa for one hour. The bath can thus be filled with carbonic water having a carbonic acid gas concentration of 810 mg/L. Subsequently, a concentration maintaining step was carried out at a carbonic acid gas pressure of 0.1 MPa, and the concentration of carbonic acid gas in carbonic water in the bath could be maintained at 840 to 880 mg/L for five hours. The specific data in this example are shown in Table 4 below.

TABLE 4

| Lapsed time (hour:min) | Pressure of carbonic acid gas | Concentration of carbonic acid gas |
|---|---|---|
| 0:00 | 0.2 MPa | 10 mg/L |
| 0:30 | 0.2 MPa | 480 mg/L |
| 1:00 | 0.1 MPa | 810 mg/L |
| 1:30 | 0.1 MPa | 840 mg/L |
| 2:00 | 0.1 MPa | 850 mg/L |
| 2:30 | 0.1 MPa | 850 mg/L |
| 3:00 | 0.1 MPa | 860 mg/L |
| 3:30 | 0.1 MPa | 860 mg/L |
| 4:00 | 0.1 MPa | 870 mg/L |
| 4:30 | 0.1 MPa | 870 mg/L |
| 5:00 | 0.1 MPa | 870 mg/L |
| 5:30 | 0.1 MPa | 870 mg/L |
| 6:00 | 0.1 MPa | 880 mg/L |

As described above, according to the second aspect of the present invention, the problem of evaporation of carbonic acid gas from the thus produced carbonic water can be solved, and a certain concentration of carbonic acid gas can be produced and maintained by a simple operation at low cost for a long period of time.

Next, Example C regarding the third aspect of the present invention will be described.

EXAMPLE C1

Carbonic water was produced as described below using the apparatus according to the flow sheet shown in FIG. 6. As the carbonic acid gas dissolving apparatus 45, a dissolving apparatus was used containing the three-layer complex hollow fiber membrane described above (manufactured by Mitsubishi Rayon Co., Ltd., trade name: MHF) at an effective total membrane area of 2.4 $m^2$, and a carbonic acid gas was fed on the outer surface side of the hollow fiber membrane and raw water was fed to the hollow side, to dissolve the carbonic acid gas.

First, the intended concentration of the carbonic acid gas in the carbonic water to be produced was set at 600 mg/L. Next, hot water (raw water) prepared by heating tap water at 40?C was fed to the carbonic acid gas dissolving apparatus 45 at any flow rate. The flow rate of the hot water detected by the flow sensor 4 was 15 L/min.

A carbonic acid gas was fed to the carbonic acid gas dissolving apparatus 45 while automatically controlling the feeding pressure of carbonic acid gas so the concentration of carbonic acid gas of the resulting carbonic water was 600 mg/L, based on this flow rate data and the correlation data shown in FIG. 7 previously recorded. The feed pressure of carbonic acid gas in this operation was specifically 0.16 MPa. The concentration of carbonic acid gas of carbonic water thus produced was measured by an ion meter (brand IM40S manufactured by Toa Denpa Kogyo K.K.), and carbonic acid gas electrode brand CE-235. The results are shown in Table 5. In production of carbonic water, drain extraction was conducted automatically by an automatic water extraction function, and gas extraction was appropriately conducted.

Further, carbonic water was produced in the same manner excepting that the intended concentration of carbonic acid gas was set at 1000 mg/L (flow rate of hot water: 15 L/min). The feeding pressure of carbonic water was specifically 0.30 MPa. The concentration of the carbonic acid gas in thus produced carbonic water was measured in the same manner. The results are shown in Table 5.

TABLE 5

| Flow rate of hot water is 15 L/min | | |
|---|---|---|
| Set concentration | Feed pressure of carbonic acid gas | Actually measured concentration |
| 600 mg/L | 0.16 MPa | 640 mg/L |
| 1000 mg/L | 0.30 MPa | 1090 mg/L |

From the results shown in Table 5, it is apparent that carbonic water having the intended concentration could be produced with little error, at any specified concentration case.

EXAMPLE C2

Carbonic water was produced in the same manner as in Example C1 excepting that the flow rate of hot water was 5 L/min. The results are shown in Table 6.

TABLE 6

| Flow rate of hot water is 5 L/min | | |
|---|---|---|
| Set concentration | Feed pressure of carbonic acid gas | Actually measured concentration |
| 600 mg/L | 0.05 MPa | 615 mg/L |
| 1000 mg/L | 0.14 MPa | 1050 mg/L |

As apparent from the results shown in Table 6, carbonic water having the intended concentration could be produced with little error, at any specified concentration. From the results of Examples C1 and C2, it is also known that carbonic water having the intended concentration can be produced with little error, even if the flow rate of hot water (raw water) is indefinite.

As described above, according to the third aspect of the present invention, complicated control is not necessary, the constitution (construction) of the apparatus can be simplified significantly, the apparatus has small size and has a low cost, and carbonic water having the intended concentration of carbonic acid gas can be produced in a simple manner. Particularly, the third aspect of the present invention can also be applied when raw water is fed from a faucet from a water line and, additionally, since the apparatus is compact, it is very useful as an apparatus for water treatment which can be applied easily to known baths, including domestic baths.

Next, Example D regarding the fourth present invention will be described.

EXAMPLE D1

Carbonic water was produced using the apparatus according to the flow sheet shown in FIG. 6. As the carbonic acid gas dissolving apparatus 45, a dissolving apparatus was used containing the three-layer complex hollow fiber membrane described above (manufactured by Mitsubishi Rayon Co., Ltd., trade name: MHF) at an effective total membrane area of 2.4 $m^2$, and carbonic acid gas was fed on the outer surface side of the hollow fiber membrane and raw water was fed to the hollow side, to dissolve the carbonic acid gas.

First, the intended concentration of carbonic acid gas in the carbonic water to be produced was set at 1000 ppm. Next, hot water (raw water) was prepared by heating tap water at 40?C and was fed to the carbonic acid gas dissolving apparatus 45 at any flow rate. The flow rate of the hot water detected by the flow sensor 43 was 15 L/min. Here, a carbonic acid gas was fed to the carbonic acid gas dissolving apparatus 45 while appropriately controlling the feeding pressure of carbonic acid gas so the concentration of carbonic acid gas of the resulting carbonic water was 1000 mg/L. The feed pressure of carbonic water was specifically 0.30 MPa. The concentration of carbonic acid gas in the thus produced carbonic water was about 1000 ppm.

This carbonic water production was continued for 1 hour, then the feeding of raw water and the feeding of carbonic acid gas were stopped. As intended, 10 seconds after this stopping, the magnetic valve 53 of the apparatus was opened automatically for 5 seconds. In this operation, drain was discharged successfully out of the apparatus, under a remaining pressure of a gas out of a hollow fiber membrane in the carbonic acid gas dissolving apparatus 45 at about 0.05 MPa. Further, no hammer phenomenon occurred.

EXAMPLE D2

Carbonic water was produced using the apparatus according to the flow sheet shown in FIG. 3. As the carbonic acid gas dissolving apparatus 3, a dissolving apparatus was used containing the three-layer complex hollow fiber membrane described above (manufactured by Mitsubishi Rayon Co., Ltd., trade name: MHF) at an effective total membrane area of 0.6 $m^2$, and carbonic acid gas was fed on the outer surface side of the hollow fiber membrane and raw water was fed to the hollow side, to dissolve the carbonic acid gas.

Hot water in the amount of 10 L and at a temperature of 35?C filled in the bath 11 was circulated at a flow rate of 5 L/min by the circulation pump 1, and simultaneously, carbonic acid gas was fed under a pressure of 0.15 MPa to the carbonic acid gas dissolving apparatus 3. By this circulation, the concentration of carbonic acid gas in hot water in the bath 11 increased gradually. When this circulation was continued for five minutes, the concentration of carbonic water in the bath reached around 1000 ppm. Since the operation was repeated several times (integration time: four hours or more), drain was collected in the carbonic acid gas dissolving apparatus 3 after production of carbonic water. In completion of the next operation, the magnetic valve 7 was automatically opened for 1 second, as set. Since, in this time, the carbonic acid gas magnetic valve 6 was opened, a gas pressure of 0.15 MPa was applied, and under this pressure, the drain was discharged successfully out of the apparatus. Furthermore, the same carbonic water production was repeated, and consequently after every operation for an integrated operation time of four hours or more, water extraction was successfully conducted automatically in initiation of the next operation, as set.

As described above, according to the fourth aspect of the present invention, effective membrane area can always be secured without requiring manual drain extraction, and carbonic water of high concentration can be successfully produced by a simple operation. As a result, the fourth aspect of the present invention is very practical.

Next, Example E in which feeding to a plurality of use points is conducted will be described.

EXAMPLE E1

Carbonic water was produced and fed as described below, according to the example shown in FIG. 8. In the carbonic water production apparatus 100, as the carbonic acid gas dissolving apparatus 65, a dissolving apparatus was used containing the three-layer complex hollow fiber membrane described above (manufactured by Mitsubishi Rayon Co., Ltd., trade name: MHF) at an effective total membrane area of 2.4 $m^2$, and carbonic acid gas was fed on the outer surface side of the hollow fiber membrane and raw water was fed to the hollow side, to dissolve the carbonic acid gas. The water storage tank 200 was a tank in the form of cylinder having an inner volume of 1000 L. The carbonic acid gas saturation concentration in the water storage tank 200 is about 1100 mg/L at 40?C under atmospheric pressure, the production concentration in the carbonic water production apparatus 100 was 1000 mg/L. The number of use points were five in total, water is fed via each point into each bath of 250 L, supposing water can be fed at a maximum rate of about 15 L/min at each use point, and a commonly used swirling pump having a water conveying ability of 100 L/min was used as the water conveying pump 82.

First, hot water (raw water) prepared by heating tap water at 40?C was fed to the carbonic acid gas dissolving apparatus 65 at a flow rate of 15 L/min, and carbonic acid gas was fed to the carbonic acid gas dissolving apparatus 65 under a feeding pressure of 0.30 MPa. The concentration of carbonic acid gas of the produced carbonic water was about 1000 ppm, and this was fed to the water storage tank 200. Carbonic water in the water storage tank 200 was kept at 40?C. This carbonic water could be successfully fed to each use point 300 by the water conveying pump 82.

As described above, in this example, equipment cost could be reduced by one carbonic water production apparatus even when carbonic water was fed to a plurality of use points (e.g., bath). Namely, by effecting such an application, operation can be carried out by one carbonic water production apparatus, even in a facility having a lot of use points provided, and a large amount of carbonic water can be stored in a water storage tank. Therefore, even when a large amount of carbonic water is necessary at one time, a small dissolving apparatus can be used in a carbonic water production apparatus, and therefore lower the equipment cost. Furthermore, carbonic water having a high concentration of carbonic acid gas, which provides physiological effects, can be supplied easily in a stable manner.

Next, Example F regarding the fifth present invention will be described.

EXAMPLE F1

A foot bath using the circulation type carbonic water production apparatus shown in FIG. 9 was produced as described below and used. In the carbonic water production apparatus 400, as the carbonic acid gas dissolving apparatus 106, a dissolving apparatus was used containing the three-layer complex hollow fiber membrane described above (manufactured by Mitsubishi Rayon Co., Ltd., trade name: MHF) at an effective total membrane area of 0.6 $m^2$, and a carbonic acid gas was fed on the outer surface side of the hollow fiber membrane and raw water was fed to the hollow side, to dissolve the carbonic acid gas. As the circulation pump 104, a commonly used swirling pump (magnet pump manufactured by Iwaki) was used. The size of the foot bath was set within the above-mentioned range corresponding to a wheel chair, and hot water was circulated for 3 minutes at a bath volume of 11 L, a water temperature of 40?C and a circulation flow rate of 5.4 L/min, consequently, the bath was filled with carbonic water having concentration shown in Table 7 below.

TABLE 7

| Pressure of carbonic acid gas | Concentration of carbonic acid gas |
|---|---|
| 0.1 MPa | 520 mg/L |
| 0.2 MPa | 815 mg/L |

The concentration of carbonic acid gas is a value measured by a measuring apparatus (an IM-40 brand, a measuring apparatus manufactured by Toa Denpa K.K.)

EXAMPLE F2

A foot bath using the one-pass type carbonic water production apparatus shown in FIG. 10 was produced as described below and used. In the carbonic water production apparatus 500, as the carbonic acid gas dissolving apparatus 106, a dissolving apparatus was used containing the three-layer complex hollow fiber membrane described above (manufactured by Mitsubishi Rayon Co., Ltd., trade name: MHF) at an effective total membrane area of 0.6 $m^2$, and carbonic acid gas was fed on the outer surface side of the hollow fiber membrane and raw water was fed to the hollow side, to dissolve the carbonic acid gas. The size of the foot bath was set within the above-mentioned range corresponding to a wheel chair, and the water temperature was controlled to 40?C, the raw water flow rate was controlled to 5.4 L/min, and the carbonic acid gas pressure was controlled to 0.2 MPa, and thus, carbonic water having a concentration of carbonic acid gas of 794 mg/L could be filled in the bath.

As described above, according to the fifth aspect of the present invention, a bath can be provided which is simple to operate and which retains the advantage of portable foot baths.

The invention claimed is:

1. A carbonic water production apparatus which is equipped with a membrane-type carbonic acid gas dissolving apparatus, and further comprising an automatic water extraction means for automatically discharging out a drain water accumulated in the membrane-type carbonic acid gas dissolving apparatus, a magnetic valve in operative connection with said automatic water extraction means and said drain to permit periodic discharge from said drain, said automatic water extraction means automatically and periodically opening said magnetic valve to discharge the accumulated water out the drain; a water storage tank, wherein carbonic water produced by the carbonic water production apparatus is stored in the water storage tank; and a water conveying pump for feeding the carbonic water stored in the water storage tank to a plurality of use points.

2. A carbonic water production method which applies a membrane-type carbonic acid gas dissolving apparatus, and further comprising a step of automatically discharging out a drain water accumulated in the membrane-type carbonic acid gas dissolving apparatus, a magnetic valve in operative connection with an automatic water extraction means and said drain to permit periodic discharge from said drain, said automatic water extraction means automatically and periodically opening said magnetic valve for discharging the accumulated water out the drain; a water storage tank, wherein carbonic water produced by the carbonic water production apparatus is stored in the water storage tank; and using a water conveying pump to feed the carbonic water stored in the water storage tank to a plurality of use points.

3. The carbonic water production apparatus according to claim 1, which is further equipped with a bubble generation apparatus or an injection apparatus.

4. The carbonic water production apparatus according to claim 1, wherein the water storage tank is provided with means so that a gas phase inside of the water storage tank, when the gas phase is filled with a carbonic acid gas, is kept at a gas pressure of 1 kPa to 3 kPa.

5. The carbonic water production apparatus according to claim 1, wherein means for additionally introducing and feeding a carbonic acid gas into the gas phase inside of the water storage tank when the water level of carbonic water inside of the water storage tank is reduced, and means for partially discharging the carbonic acid gas of the gas phase inside the water storage tank when the water level of carbonic water inside of the water storage tank is increased.

6. The carbonic water production apparatus according to claim 1, which is equipped with an insertion tube inside of the water storage tank wherein the tube feeds the carbonic water produced by the carbonic water production apparatus into the water storage tank.

* * * * *